US006418848B1

(12) United States Patent
Fujimoto et al.

(10) Patent No.: US 6,418,848 B1
(45) **Date of Patent: *Jul. 16, 2002**

(54) INK SUPPLY APPARATUS FOR PRINTING PRESS AND INK TRAY MOUNTED ON THE SAME APPARATUS

(75) Inventors: Shinichi Fujimoto; Teruaki Kihara, both of Mihara (JP)

(73) Assignee: Mitsubishi Heavy Industries, Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/540,803

(22) Filed: Mar. 31, 2000

(30) Foreign Application Priority Data

| | | |
|---|---|---|
| Mar. 31, 1999 | (JP) | 11-090624 |
| Jun. 15, 1999 | (JP) | 11-168112 |
| Aug. 3, 1999 | (JP) | 11-219835 |

(51) Int. Cl.[7] ..... B41F 31/02; B41F 31/00

(52) U.S. Cl. ..... 101/367; 101/350.1

(58) Field of Search ..... 101/49, 205, 206–210, 101/315, 321, 326, 330, 331, 340, 344, 347, 350.1, 350.6, 355, 356, 360, 363, 364, 365, 367

(56) References Cited

U.S. PATENT DOCUMENTS

| | | | | |
|---|---|---|---|---|
| 3,318,239 A | * | 5/1967 | Wintzer | 101/364 |
| 3,788,220 A | * | 1/1974 | Laben et al. | 101/363 |
| 5,167,188 A | | 12/1992 | Lindblom | |
| 5,327,830 A | | 7/1994 | Gelinas et al. | |
| 5,481,974 A | * | 1/1996 | Sarazen et al. | 101/363 |
| 5,727,463 A | | 3/1998 | Deschner et al. | |
| 5,979,321 A | | 11/1999 | Koppelkamm et al. | |

FOREIGN PATENT DOCUMENTS

| | | |
|---|---|---|
| JP | 04022639 | 1/1992 |
| JP | 4-234654 | 8/1992 |
| JP | 07309004 | 11/1995 |

OTHER PUBLICATIONS

Translation of Official Action dated Oct. 21, 1999 from Japanese Patent Office.

* cited by examiner

*Primary Examiner*—Eugene Eickholt
(74) *Attorney, Agent, or Firm*—Alston & Bird LLP

(57) ABSTRACT

The present invention provides an ink supply apparatus for a printing press in which the ink supply amount from an ink fountain to an ink fountain roller is controlled by regulating a gap between ink blades and the ink fountain roller, wherein an integral type ink tray comprising a bottom portion covering portions of the upper faces of the ink blades excluding the distal end portions thereof and side portions covering the inside surfaces of side plates is provided, a first seal member is interposed between the inside surface of the side plate and the side portion, and a second seal member in slidable contact with the ink blades is interposed between the ink blades and the bottom portion of the ink tray.

20 Claims, 16 Drawing Sheets

INK SUPPLY APPARATUS FOR PRINTING PRESS AND INK TRAY MOUNTED ON THE SAME APPARATUS

BACKGROUND OF THE INVENTION AND RELATED ART STATEMENT

1. Field of the Invention

The present invention relates to an ink supply apparatus for a printing press and an ink tray mounted on the same apparatus and, more particularly, to an ink supply apparatus capable of being provided on a rotary press, a sheet-feed press, and the like, and an ink tray mounted on the same apparatus.

Also, the present invention relates to an ink tray suitably used for an ink supply apparatus provided with an ink fountain, and a method for mounting a contamination preventive surface cover to an ink tray.

Further, the present invention relates to an ink supply apparatus for a printing press such as a rotary press and a sheet-feeding press and, more particularly, to an ink supply apparatus provided with an ink tray detachably mounted on an ink fountain.

2. Description of Related Art

FIGS. 22 and 23 show a conventional ink supply apparatus provided on a printing press such as a rotary press and a sheet-feed press.

A conventional ink supply apparatus 51 has an ink fountain 53 arranged in front of an ink fountain roller 52. The ink fountain 53 is composed of two side plates 53*a* (only one side is shown), which are located on both end sides in the axial direction (i.e. axial ends) of the ink fountain roller 52, with a part of the front end of each side plate 53*a* being brought into slidable contact with the outer peripheral surface of the ink fountain roller 52, an ink blade 54 forming the bottom surface of the ink fountain 53, and the like.

The ink blade 54 is made up of a plurality of ink keys 54*a* to 54*n* divided in the axial direction of the ink fountain roller 52. Each of the ink keys 54*a* to 54*n* can independently be swayed, i.e., moved vertically by pivoting, around a support shaft 55, and an ink amount regulating device is provided under each of the ink keys 54*a* to 54*n*. The ink amount regulating device is provided with an arm plate 59 engaging with the lower face at the distal end of each of the ink keys 54*a* to 54*n* and a pusher 58 is in contact with the arm plate 59 and sways, i.e. causes pivoting and vertical movement of the arm plate 59 by extension and contraction. The pusher 58 is appropriately extended and contracted by turning a knob 56 or by a motor 57 arranged to turn the arm plate 59, whereby each of the ink keys 54*a* to 54*n* can be swayed vertically. By vertically swaying each of the ink keys 54*a* to 54*n* in this manner, a gap between the ink key 54*a* to 54*n* and the ink fountain roller 52 can be regulated so that the thickness of ink film formed on the outer peripheral surface of the ink fountain roller 52 is made uniform in the axial direction of the roller 52.

Ink 60 supplied into the ink fountain 53 passes through the gap between the outer peripheral surface of the ink fountain roller 52 and the distal end of the ink key 54*a* to 54*n* to adhere to the ink fountain roller 52, and so that it can be transferred by the rotation of the roller 52. Subsequently, the ink 60 is transferred to an ink roller group via a vibrating roller (not shown), which comes into contact with and separates from the ink fountain roller 52, and is used for printing.

Leakage of the ink 60 from the ink fountain 53 in the axial direction of the ink fountain roller 52 is prevented by slidable contact made between the ink fountain roller 52 and the side plates 53*a*, 53*a* of the ink fountain 53. Also, the ink 60 is prevented from flowing downwardly through gaps between the ink keys 54*a* to 54*n* by slidable contact made between the adjacent ink keys 54*a* to 54*n*.

Reference numeral 61 in FIG. 22 denotes an ink recovery tray, and reference numeral 62 in FIG. 23 denotes a frame for the ink supply apparatus 51.

The above-described conventional ink supply apparatus 51 has the following problems:

First, a minute gap is provided between the adjacent ink keys 54*a* to 54*n* and between each of the end ink keys 54*a*, 54*n* and each side plate 53*a* so that these elements are slidable. Therefore, ink sometimes intrudes into the minute gap by capillarity etc. Specifically, the ink 60 put in the ink fountain 53 intrudes into the gap between the adjacent ink keys 54*a* to 54*n* and solidifies. Thereby, the movement (vertical sway) of the ink keys 54*a* to 54*n* sometimes becomes unstable. Further, the ink 60 put in the ink fountain 53 intrudes into the gap between the adjacent ink keys 54*a* to 54*n* over the whole region from the vicinity of liquid surface of the ink 60 to the distal end of the ink key 54*a* to 54*n*, so that there is a possibility of the ink keys 54*a* to 54*n* each becoming unmovable in the worst case. Therefore, it is impossible to carry out accurate control of ink film thickness.

Secondly when the ink fountain 53 is cleaned, it is difficult to remove the remaining ink 60. In particular, it is difficult to remove the ink 60 having intruded into the gap between the adjacent ink keys 54*a* to 54*n*.

Specifically, when the printing operation is completed or the ink is changed, the ink remaining in the ink fountain 53 must be wiped off with a waste cloth or the like or washed off with a cleaning fluid. However, it is difficult to remove the ink because of its high viscosity. In particular, it is difficult to remove the ink having intruded into the gap between the ink keys 54*a* to 54*n*, which leads to an increased burden to an operator performing the cleaning work. Further, in order to enhance the productivity, it is necessary to shorten the preparation time at the time of order change to increase the rate of operation of equipment. If the load caused by cleaning at the time of ink change is high, however, much time is consumed for cleaning. Therefore, the alleviation of burden to the operator by reduction in labor in cleaning work, the increase in rate of operation of equipment by shortened cleaning time, and the enhancement of productivity would be desirable.

OBJECT AND SUMMARY OF THE INVENTION

The present invention has been made in view of the above situation, and accordingly in one aspect thereof an object is to provide an ink supply apparatus for a printing press, in which ink keys forming the bottom portion of an ink fountain can be operated stably, and ink intruding into gaps between the adjacent ink keys can be removed easily.

In another aspect, an object of the present invention is to provide an ink tray and a method for mounting a contamination preventive surface cover to the ink tray, in which labor saving and shortened work time for cleaning work for ink change etc. on the printing press can be achieved.

In still another aspect, an object of the present invention is to provide an ink supply apparatus in which labor saving for cleaning work for ink change etc. on the printing press can be achieved.

To address the above object(s), the present invention provides an ink supply apparatus for a printing press having an ink fountain formed by an ink fountain roller, a plurality of ink blades arranged in the axial direction of the ink fountain roller, and side plates holding the ink blades therebetween from both sides, so that the ink supply amount from the ink fountain to the ink fountain roller is controlled by regulating a gap between the ink blades and the ink fountain roller, wherein an integral type ink tray is provided comprising a bottom portion covering portions of the upper faces of the ink blades while not covering the distal end portions of the blades the ink tray for the comprising side portions covering the inside surfaces of the side plates, and a first seal member is interposed between the inside surface of the side plate and the side portion, and a second seal member in slidable contact with the ink blades is interposed between the ink blades and the bottom portion of the ink tray.

In one advantageous embodiment, the present invention provides an ink tray mounted in an ink fountain of a printing press which is formed, by an ink fountain roller, a plurality of ink blades arranged in the axial direction of the ink fountain roller, and side plates holding the ink blades therebetween from both sides, wherein the ink tray is integrally formed by a bottom portion covering portions of the upper faces of the ink blades while not covering the distal end portions thereof and by side portions covering the inside surfaces of the side plates, and the ink tray is mounted in the ink fountain in such a manner that a first seal member is interposed between the inside surface of the side plate and the side portion, and a second seal member is interposed between the ink blades and the bottom portion of the ink tray.

As described above, according to the ink supply apparatus for a printing press in accordance with the present invention, in an ink supply apparatus for a printing press having an ink fountain formed by an ink fountain roller, a plurality of ink blades arranged in the axial direction of the ink fountain roller, and side plates holding the ink blades therebetween from both sides, so that the ink supply amount from the ink fountain to the ink fountain roller is controlled by regulating a gap between the ink blades and the ink fountain roller, an integral type ink tray comprising a bottom portion covering portions of the upper faces of the ink blades while not covering the distal end portions thereof and further comprising side portions covering the inside surfaces of the side plates, is provided, and a first seal member is interposed between the inside surface of the side plate and the side portion, and a second seal member in slidable contact with the ink blades is interposed between the ink blades and the bottom portion of the ink tray. Therefore, the effects described below can be achieved.

In the present invention, since most portions of the ink blades are covered by the ink tray, the region (area) of the ink keys that is in contact with the ink is significantly reduced as compared with the conventional apparatus. Thereby, the gaps between the adjacent ink keys are less clogged with ink, and the portions contaminated with ink are reduced. Therefore, the ink keys forming the bottom portion of the ink fountain can be operated stably, and the ink intruding into the gaps between the adjacent ink keys can be removed easily. Moreover, since the ink tray cleaning work and the ink changing work for order change etc. can be performed on the outside of the apparatus after the ink tray has been removed from the ink fountain, ink recovery and cleaning are made easy, so that labor saving and shortened work time can be achieved. Further, since a region where ink intrudes into the gaps between the adjacent ink keys is limited to a narrow region of only the distal end portions of the ink keys, the problem of the vertically swaying operation of the ink keys becoming unsmooth can be eliminated to the utmost.

Also, in the present invention, a plate-shaped elastic member is provided on the lower surface of the bottom portion of the ink tray, and the contact between the bottom portion of the ink tray and the ink keys is always maintained via the plate-shaped elastic member. Therefore, even if a change in height (change in relative vertical position) of the ink tray with respect to the ink fountain occurs, the contacting state between the bottom portion of the ink tray and the ink key can always be maintained by the plate-shaped elastic member.

Further, in the present invention, the shape of a step portion of the ink key in contact with the second seal member is formed into an arcuate curved face substantially concentric with a turning center around which the ink key is turned to regulate the amount of ink, or formed into a planar face approximate the tangential movement with respect to the curved face. Thereby, even if the position of the ink key is chanced in order to regulate the amount of ink, the contacting state between the second seal member and the seal face of the ink key is not changed. Therefore, the sealing state therebetween can be maintained.

Still further, in the present invention, since at least a portion of the first and second seal members contacting with the step portion of the ink key is formed of an elastic material, the contact between the first and second seal members and the step portion of the ink key can be maintained.

In addition, in the present invention, the first and second seal members are formed integrally from a single seal member, and the seal member is detachably installed in a holder provided on the ink tray, whereby the attachment/detachment work and replacement work of the seal member can be performed easily and rapidly. Specifically, for example, the cleaning work of the ink tray can be performed easily in a state in which the continuous seal member has been pulled out of the holder.

On the other hand, to achieve the above object, an ink tray in accordance with another advantageous aspect of the present invention includes a groove portion fitted with a seal member for sealing a gap between the distal end edge portions of the side walls and of a bottom plate of the ink tray, and the ink fountain, when the ink tray is mounted in the ink fountain. The groove portion is provided at the distal end edge portions of the ink tray, and the front end portion of the surface cover is held between the groove portion and the seal member to fix the surface cover to the ink tray.

In another advantageous aspect, the present invention provides a method for mounting a contamination preventive surface cover to an ink tray for an ink supply apparatus, in which a contamination preventive surface cover covering a portion of the tray to which ink adheres when the ink is put in an ink fountain, is mounted on the surface of the ink tray which is detachably mounted in the ink fountain for the ink supply apparatus, comprising the steps of: placing the surface cover on the upper surface of the ink tray; and holding the front end portion of the surface cover between a groove portion provided on the ink tray and a seal member fitted in the groove portion to fix the surface cover to the ink tray.

An ink tray provided in accordance with another advantageous aspect of the present invention is detachably mounted in an ink fountain of an ink supply apparatus. The ink tray comprises a groove portion fitted with a seal member for sealing a gap between the distal end edge portions of the side walls and of a bottom plate of the ink tray and the ink fountain when the ink tray is mounted in the ink fountain. The groove portion is provided at the distal end edge portions of the ink tray, and the groove portion and an essential portion in the vicinity of the groove portion are coated with a film capable of being peeled off.

An ink tray in accordance with another advantageous embodiment of the present invention is detachably mounted in an ink fountain of an ink supply apparatus, and is characterized in that a groove portion fitted with a seal member for sealing a gap between the distal end edge portions of side walls and of a bottom plate of the ink tray and the ink fountain when the ink tray is mounted in the ink fountain, is provided at the distal end edge portions of the ink tray, and the groove portion and at least portions of the tray in the vicinity of the groove portion are coated with a film less likely to be contaminated with ink i.e., a nonstick contact surface film.

In accordance with the above advantageous ink tray and with the above method for mounting a contamination preventive surface cover to an ink tray in accordance with the present invention, even when the ink tray is mounted in the ink fountain and ink is put in the ink fountain, the ink does not adhere to the surface of the ink tray because the surface of the ink tray is covered by the surface cover. At the time of cleaning, therefore, it is necessary only that the surface cover to which ink adheres be removed from the ink tray and replaced with a new surface cover. Therefore, the cleaning work is made easy at the time of ink change or at the completion of printing operation, so that the operator's burden is alleviated.

Also, according to the ink tray in accordance with the preferred embodiments of the present invention, since the peripheral portion of the groove portion fitted with the seal member, which is especially difficult to clean when ink adheres, is coated with a film, the ink tray can be cleaned only by removing ink from the bottom plate and the side walls, from which ink can be removed relatively easily. Therefore, the cleaning work is made easy at the time of ink change or at the completion of printing operation, so that the operator's burden is alleviated.

Further, according to the ink tray in accordance with preferred embodiments of the present invention, since the peripheral portion of the groove portion fitted with the seal member is coated with a film less likely to be contaminated with ink, the portion from which ink is removed with special difficulty when ink adheres can be cleaned easily. Therefore, the cleaning work is made easy at the time of ink change or at the completion of printing operation, so that the operator'burden is alleviated.

On the other hand, yet another aspect of the present invention provides an ink supply apparatus for a printing press, comprising an ink fountain roller, right and left side plates which are in slidable contact with the peripheral surface of the ink fountain roller and form an ink fountain, and ink keys forming the bottom portion of the ink fountain, wherein an ink tray comprising side walls corresponding to the side plates and a bottom plate corresponding to the ink keys is mounted in the ink fountain so that the distal end portion of the side wall is disposed on the inside of the side plate in such a manner as to be lapped on the side plate.

According to one preferred embodiment of the above aspect of the present invention, a step portion is formed on the ink key, and the distal end of the bottom plate is caused to abut on the step portion.

According to another preferred embodiment of this aspect of the present invention, a step portion is formed on the side plate, and a seal member continuous from the distal end of the bottom plate to the outside surface of the side walls is provided on the ink tray, so that the seal member is brought into contact with the step portion formed on the ink key and the step portion formed on the side plate. Advantageously the distal end of the side wall is inclined with respect to the bottom plate.

It is also preferred that a step portion is formed on the side plate, and a portion of the seal member provided on the outside surface of the side wall is locked by the step portion of the side plate.

According to the ink supply apparatus in accordance with these advantageous aspects of the present invention, the contact area of the ink key with ink can be reduced significantly by mounting the ink tray in the ink fountain. Thereby, the possibility of ink protruding into the gaps between the ink keys is lessened to stabilize the operation of the ink keys, and also the inside of the ink fountain can be cleaned easily. Therefore, the cleaning time at the time of ink change is shortened, whereby the productivity can be enhanced.

Also, since the distal end portion of the side wall of the ink tray is disposed on the inside of the side plate of the ink fountain in such a manner as to be lapped on the side plate, the transverse positioning of the ink tray can be performed easily.

Also, since the distal end of the bottom plate is caused to abut on the step portion formed on the ink key, the longitudinal positioning of the ink tray can be performed easily.

Further, since the seal member is brought into contact with the step portion formed on the ink key, ink leakage through the gap between the distal end of the bottom plate and the step portion can be prevented reliably.

Further, in the embodiments wherein the distal end edge of the side wall is inclined with respect to the bottom plate, and the seal member is provided continuously from the distal end of the bottom plate at a position shifted rearward from the distal end edge on the outside surface of the side wall, even when the distal end edge of the side wall is inclined with respect to the bottom plate, the seal member can be set in a natural form without being bent into a three-dimensional, unnatural shape.

Further, in the embodiments wherein the step portion is formed on the side plate, and a portion of the seal member provided on the outside surface of the side wall is locked by the step portion of the side plate, ink leakage through the gap between the side plate and the side wall can be prevented while the longitudinal positioning of the ink tray is performed reliably.

DETAILED DESCRIPTION OF PREFERRED EMBODIMENTS

Figure 1:
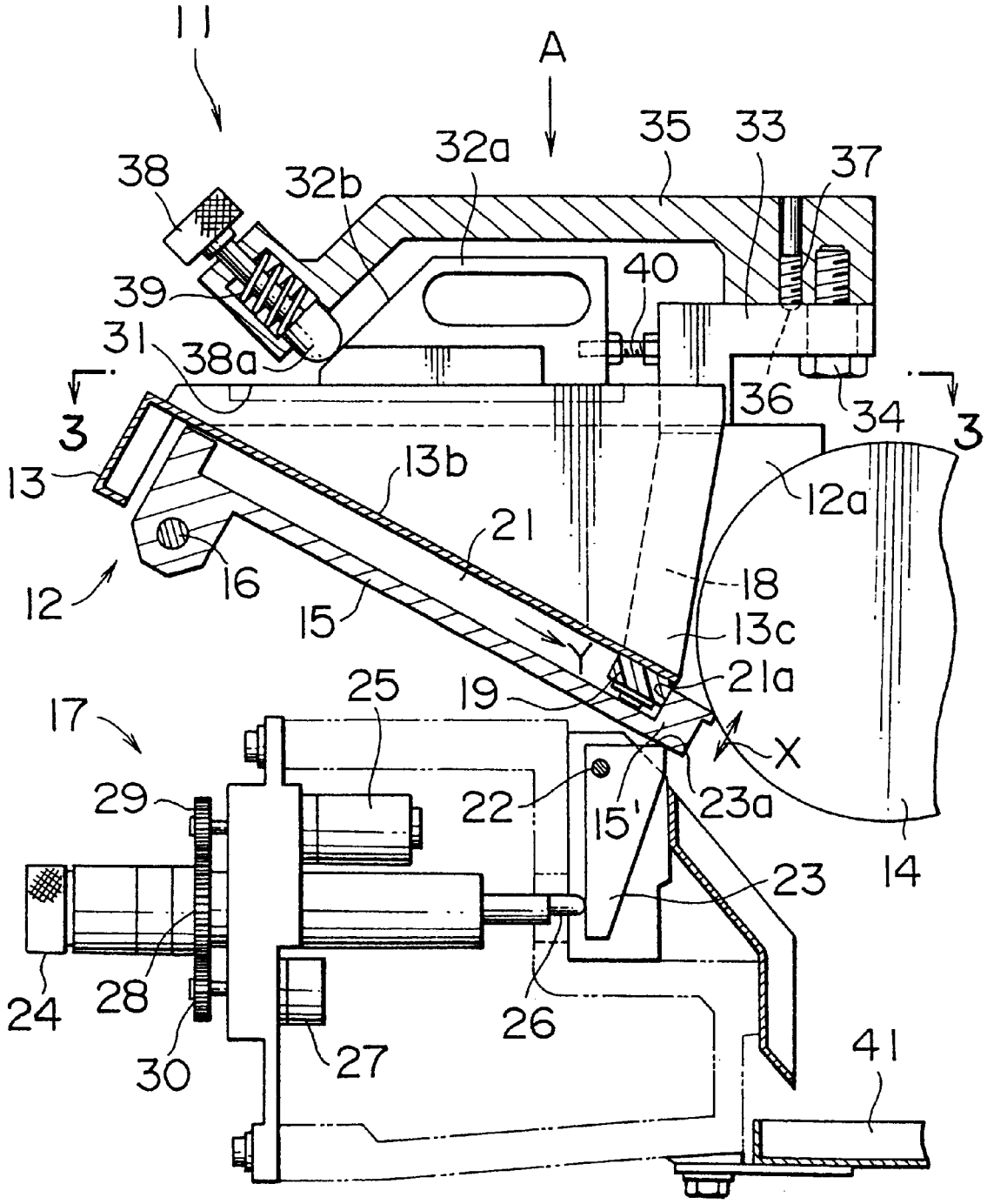
FIG. 1 is a longitudinal sectional view showing a first embodiment of an ink supply apparatus for a printing press in accordance with the present invention.

An ink supply apparatus for a printing press and an ink tray mounted on the same apparatus, in accordance with the present invention, will be described now in detail with reference to the accompanying drawings. FIGS. 1 to 4 show a first embodiment of an ink supply apparatus for a printing press in accordance with the present invention.

An ink supply apparatus 11 for a printing press of this embodiment is provided with an ink tray 13 detachably mounted in an ink fountain 12. The ink fountain 12 is composed of side plates 12*a*, 12*a* which are fixed to an apparatus frame and positioned on each of the end portions in the axial direction of an ink fountain roller 14, an ink blade 15 forming the bottom surface of the ink fountain 12, and the like (see FIG. 1). The front end of each side plate 12*a*, 12*a* is in slidable contact with the outer peripheral surface of the ink fountain roller 14. The ink blade 15 is constructed so as to be divided into a plurality of ink keys 15*a* to 15*n* in the axial direction of the ink fountain roller 14. These ink keys 15*a* to 15*n* each are pivotable vertically around a support shaft 16 by a plurality of drive units 17.

The ink tray 13 is formed integrally by joining side portions 13*a*, 13*a* covering the inside surface of the right and left side plates 12*a*, 12*b* of the ink fountain 12 to a bottom portion 13*b* covering the ink blade 15 of the ink fountain 12. The bottom portion 13*b* covers the upper face of the ink blade 15 excluding a distal end portion 15'. The material forming the side portion 13*a* and the bottom portion 13*b* should preferably be, for example, a stainless steel sheet with a thickness of about 1 mm, but the material is not limited to this.

End portions 13*c*, 13*c* on the side of the ink fountain roller 14 on the outside faces of the side portions 13*a*, 13*a* of the ink tray 13 are fitted with a first seal member 18 along the depth direction of the ink fountain 12. Also, on the lower surface of the end portion on the side of the ink fountain roller 14 of the bottom portion 13*b* of the ink tray 13, a second seal member 19 is installed in parallel with the axial direction of the ink fountain roller 14. The second seal member 19 is formed integrally with, so as to be continuous with the first seal member 18 using the same material as that of the first seal member 18. The ink blade 15 is disposed, as described later, so as to be slidable with respect to the second seal member 19 at the contact portion with the second seal member 19. The present invention is not limited to the above-described configuration, and the first and second seal members 18, 18, 19 may be installed on the side of the side plate 12*a* of the ink fountain 12 and on the side of the ink blade 15.

In a state in which the ink tray 13 is mounted in the ink fountain 12, the first seal member 18, 18 is brought into contact with a step portion 20*a* on the side of the ink fountain roller 14 of a concave portion 20 formed on the inside face of the side plate 12*a*, 12*a* on each side of the ink fountain 12. Also, the second seal member 19 is brought into contact with a step portion 21*a* on the side of the ink fountain roller 14 of a substantially square-shaped concave portion 21 formed on the upper face of the ink blade 15 forming the bottom portion of the ink fountain 12 (see FIGS. 1 and 2). Specifically, the second seal member 19 abuts on the step portion 21*a* of the ink blade 15 in the sliding direction with respect to the ink blade 15 (substantially in the direction of the arrow X of FIG. 1) and in the substantially perpendicular direction (in the direction of the arrow Y of FIG. 1). By the first and second seal members 18, 18, 19, a seal is provided between the side portion 13*a,* 13*a* of the ink tray 13 and the side plate 12*a* 12*a* of the ink fountain 12, and between the bottom portion 13*b* of the ink tray 13 and the upper face of the ink blade 15 of the ink fountain 12, on the side of the ink fountain roller 14. Thereby, the ink in the ink tray 13 is prevented from leaking to between the ink tray 13 and the ink fountain 12.

The step portion 21*a* of the ink key 15*a* to 15*n* is preferably formed into an arcuate curved face with the support shaft 16, which is the turning center of movement of the ink key for regulating the amount of ink, being the center, or is preferably formed into a planar face e.g. tangential to the pivot direction approximate to the curved face. Since the distal end portion 15' turns around the support shaft 16 at the proximal end portion of the ink blade 15, a gap between the second seal member 19 and the step portion 21*a* is kept constant by the shape of the step portion 21*a* formed as described above in the height difference direction, so that the sealing property between these elements can be enhanced.

For the first and second seal members 18, 18, 19, at least portions that are in contact with the step portions 20*a,* 21*a* is preferably formed of rubber or other elastic materials, for example, silicone rubber or NBR. The contact material may be any elastic material; besides the molded product, a blanket for blanket cylinder or the like can be used.

The drive unit 17 is composed, as shown in FIG. 1, of an arm plate 23, a corner portion 23*a* of which is engaged with the lower face of the distal end portion 15' of the ink key 15*a* to 15*n* and which is i.e., rotated, around a support pin 22, a pusher 26, which engages with the lower end portion of the arm plate 23 and is extended and contracted back and forth by the turning of a knob 24 or a motor 25, an encoder 27 for detecting the movement amount of the pusher 26, and the like. The motor 25 turns a gear 28 fixed to the pusher 26 by means of a gear 29 installed at the shaft end of the motor 25 to extend and contract the pusher 25. The encoder 27 measures the rotation (angle) transmitted from the gear 28 fixed to the pusher 26 via a gear 30 to detect the movement amount of the pusher 26.

By appropriately turning the knob 24 of the drive unit 17, the pusher 26 is extended or contracted (moved back and forth), by which the arm plate 23 is swayed. Accordingly, the distal end portion 15' of the ink key 15*a* to 15*n* that is brought into contact with the corner portion 23*a* of the arm plate 23 is moved vertically, so that a gap between the distal end of the ink key 15*a* to 15*n* and the outer peripheral surface of ink fountain roller 14 can be set at a desired dimension. Thereby, the film thickness of ink transferred to the outer peripheral surface of the ink fountain roller 14 can be regulated easily, so that the ink film thickness can be made uniform over the whole region in the axial direction of the ink fountain roller 14. The detection signal from the encoder 27 is fed back to the motor 25 via a controller (not shown) to control the rotational angle of the motor 25, whereby accurate remote control can be carried out.

Figure 2:
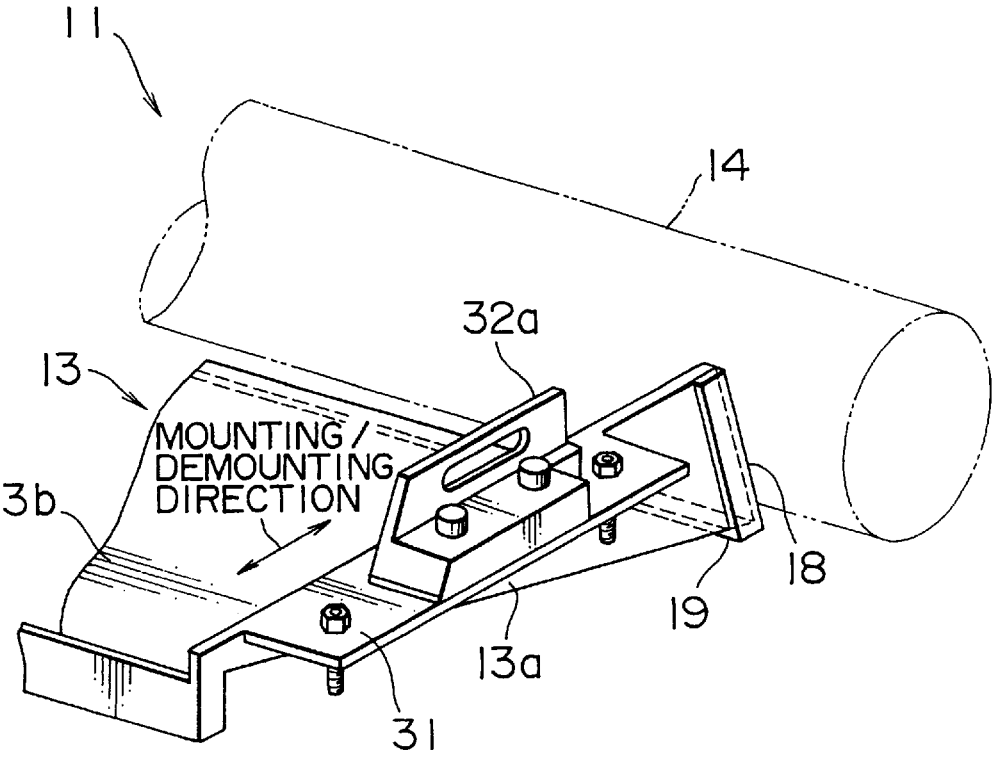
FIG. 2 is a perspective view showing the first embodiment of an ink supply apparatus for a printing press in accordance with the present invention, especially showing a state in which an ink tray is mounted.
Figure 3:
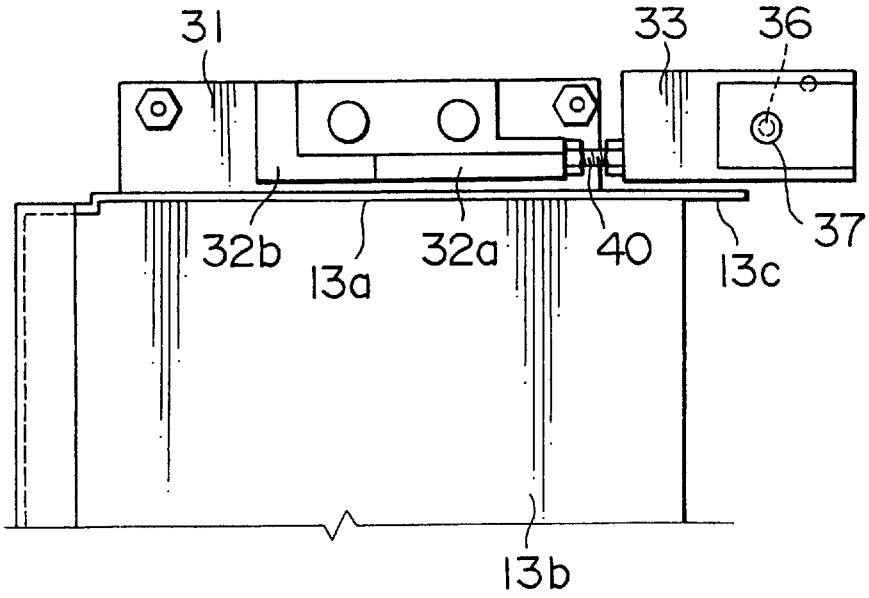
FIG. 3 is a plan view taken in the direction of the arrow A of FIG. 1.
Figure 4:
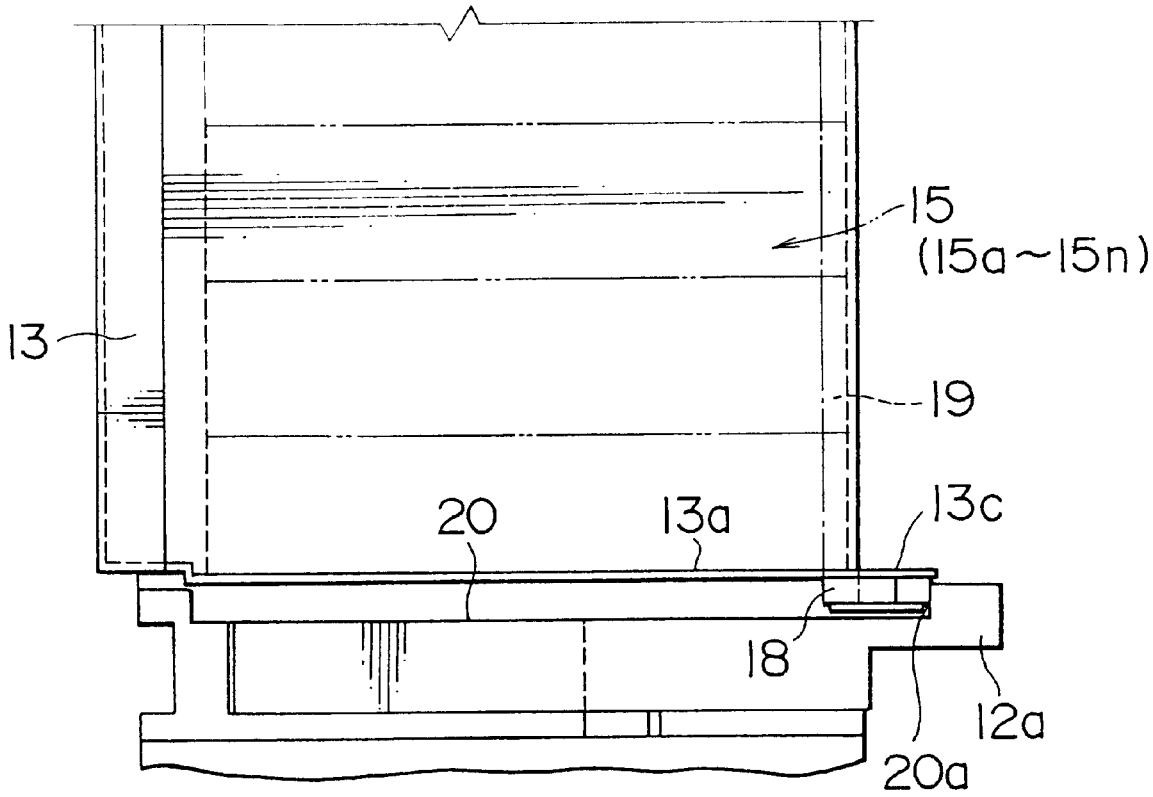
FIG. 4 is a plan view taken in the direction of the arrows along the line B—B of FIG. 1.

At the upper end of the side portion 13*a,* 13*a* of the ink tray 13, a bracket 31, 31 is fixed which is directed to the outside, and a handle 32*a* is installed to the bracket 31 (see FIGS. 2 and 3). On the upper face of the side plate 12*a,* 12*a* on each side of the ink fountain 12 is fixed a bracket 33, 33, and a lever 35 is rotatably installed to the bracket 33 via a pin 34.

The lever 35 can be turned horizontally around the pin 34, and can be moved and set at a position parallel to the side plate 12*a* of the ink fountain 12 (in the direction perpendicular to the axial direction of the ink fountain roller 14) (hereinafter, referred to as an operation position of the lever 35) and at a position swung to the outside of the side plate 12*a* (to the direction parallel to the axial direction of the ink fountain roller 14) (hereinafter, referred to as an open position of the lever 35).

At one end (on the side of the pin 34) of the lever 35, a first plunger (positioning mechanism) 37 is disposed which is provided with a steel ball 36 at the tip end and incorporates a compression spring (not shown) therein. The steel ball 36 of the first plunger 37 which is pushed out and urged by the compression spring, is received into a conical hole formed in the bracket 33, whereby the lever 35 can be fixed temporally at the operation position of the lever 35.

At the other end (on the side of the swing end of the lever 35) of the lever 35 is disposed a second plunger (suppressing mechanism) 38. The second plunger 38 incorporates a spring 39. When the ink tray 13 is mounted in the ink fountain 12 and the lever 35 is set at the operation position thereof, a plunger pin 38*a* is engaged with an inclined face 32*b* of the handle 32*a* by-the urging force of the spring 39, so that the ink tray 13 is pressed 5 toward the ink fountain roller 14. By this pressing force of the plunger pin 38*a,* the first and second seal members 18, 18, 19 of the ink tray 13 are pressed on the step portions 20*a,* 21*a* of the ink fountain 12.

The right and left handles 32*a* each are provided with a positioning bolt (positioning mechanism) 40 for the ink tray 13. By causing the positioning bolt 40 to abut on the bracket 36, the mounting position of the ink tray 13 can be regulated.

In the ink supply apparatus 11 of this embodiment, when ink is changed for order change etc., the apparatus 11 is first stopped, and the ink remaining in the ink fountain 12 is recovered in, an ink recovery tray 41 with a spatula or the like. Subsequently, the plunger pins 38*a* are raised to swing the levers 35 on both sides to the open positions thereof. Next, the ink tray 13 is removed from the ink fountain 12 by grasping the handles 32*a,* 32*a,* and the removed ink tray 13 is cleaned by wiping off the ink.

The ink remaining at the bottom of the ink fountain 12 fixed to the apparatus 11 is wiped off with a waste cloth or the like. Subsequently, another ink tray 13 or the ink tray 13 having been cleaned is mounted and fixed in the ink fountain 12 by reversing the above procedure, and new ink is put in the ink fountain 12.

According to the ink supply apparatus 11 of this embodiment, the configuration is such that the ink tray 13 fitted with the first and second seal member 18, 18, 19 as described above is detachably mounted in the fixed type ink fountain 12. Therefore, most of the ink put in the ink fountain 12 is accommodated by the outer peripheral surface of the ink fountain roller 14, and both of the side portions 13*a,* 13*a* and the bottom portion 13*b* forming the ink tray 13, so that some of the ink adheres to only the end portions on the side of the ink fountain roller 14 of the side plates 12*a,* 12*a* of the ink fountain 12 and the distal end portions 15' of the ink keys 15*a* to 15*n*.

As is apparent from the above description, the ink supply apparatus 11 of this embodiment has the following advantages:

(1) The region (area) of the ink keys 15*a* to 15*n* that is in contact with the ink is significantly reduced as compared with the conventional apparatus, and the amount of ink intruding into gaps between the adjacent ink keys is very small.

(2) Fewer portions on, for example, the ink keys 15*a* to 15*n,* the side plates 12*a,* 12*a,* and the like, other than the ink tray 13, are contaminated by the ink.

(3) Since the ink tray 13 can be cleaned on the outside of the apparatus 11 by being removed from the ink fountain 12, the cleaning work can be performed easily and rapidly.

By the above advantages (1) to (3), ink recovery and cleaning are made easy when the ink is changed for order change etc., so that labor saving and shortened operation time can be achieved.

(4) Since region (length) where the ink intrudes into the gap between the adjacent ink keys 15*a* to 15*n* is limited to the distal end portions 15' of the ink keys 15*a* to 15*n,* there is no trouble such that the vertical swaying operation of the ink keys 15*a* to 15*n* becomes unsmooth.

Figure 5:
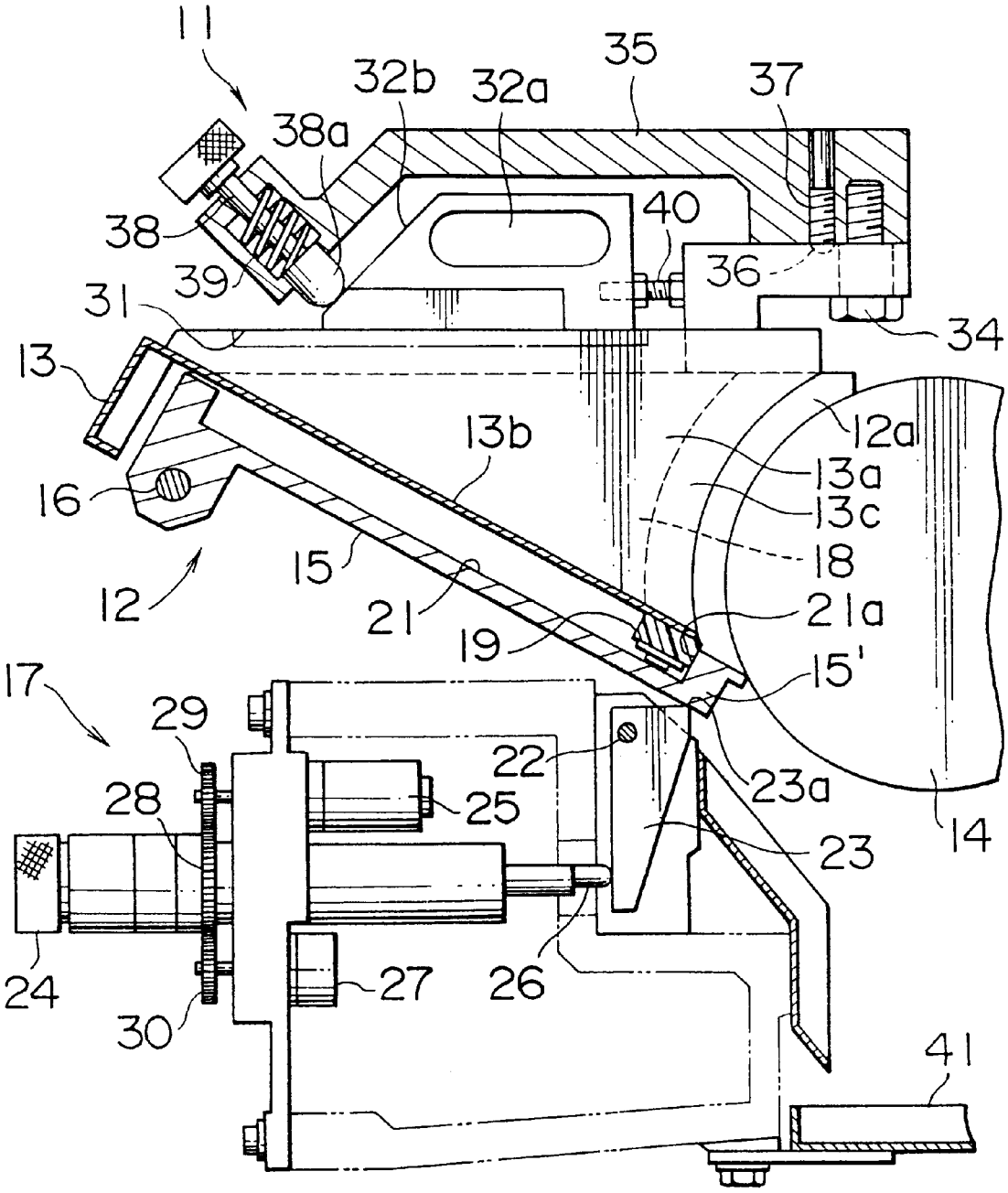
FIG. 5 is a longitudinal sectional view showing a second embodiment of an ink supply apparatus for a printing press in accordance with the present invention.
Figure 6:
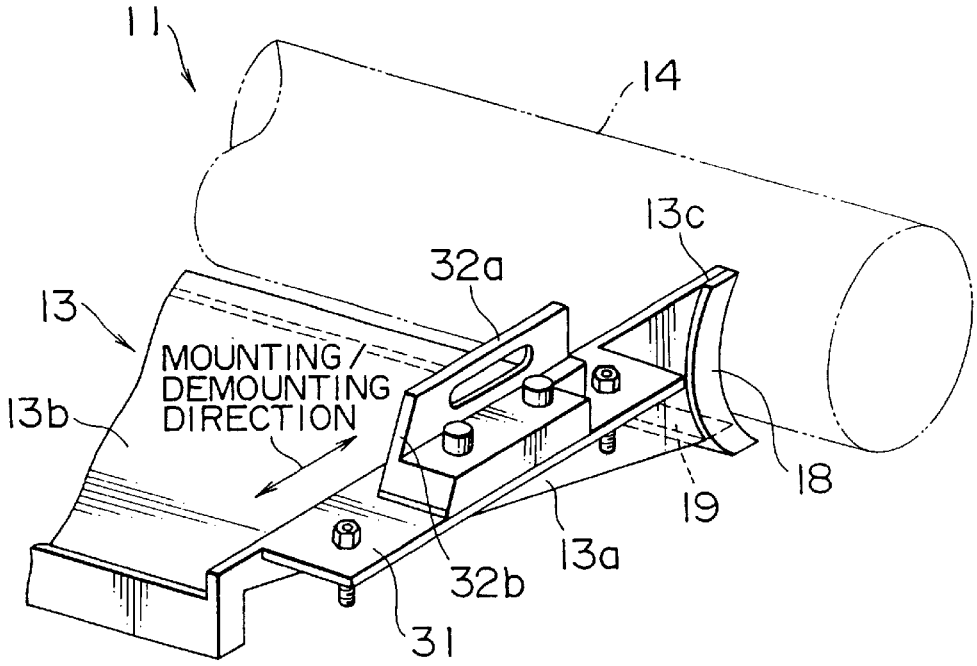
FIG. 6 is a perspective view showing the second embodiment of an ink supply apparatus for a printing press in accordance with the present invention, especially showing a state in which an ink tray is mounted.

FIGS. 5 and 6 show a second embodiment of the ink supply apparatus for a printing press in accordance with the present invention. For convenience of explanation, in FIGS. 5 and 6, the same reference numerals are applied to the elements having the same function as that of the elements shown in FIGS. 1 to 4, and the detailed description thereof is omitted.

For the ink supply apparatus 11 for a printing press of this embodiment, the end portion 13*c* on the side of the ink fountain roller 14 of the side portion 13*a* of the ink tray 13 detachably mounted in the ink fountain 12 and the seal member 18 are curved so as to correspond to the shape of the outer peripheral surface of the ink fountain roller 14. Thereby, portions contaminated by the ink in the ink fountain 12 are lessened, so that the ink changing operation for order change etc. can be made far easier. Other operation and effects are the same as in the above-described first embodiment.

Figure 7:
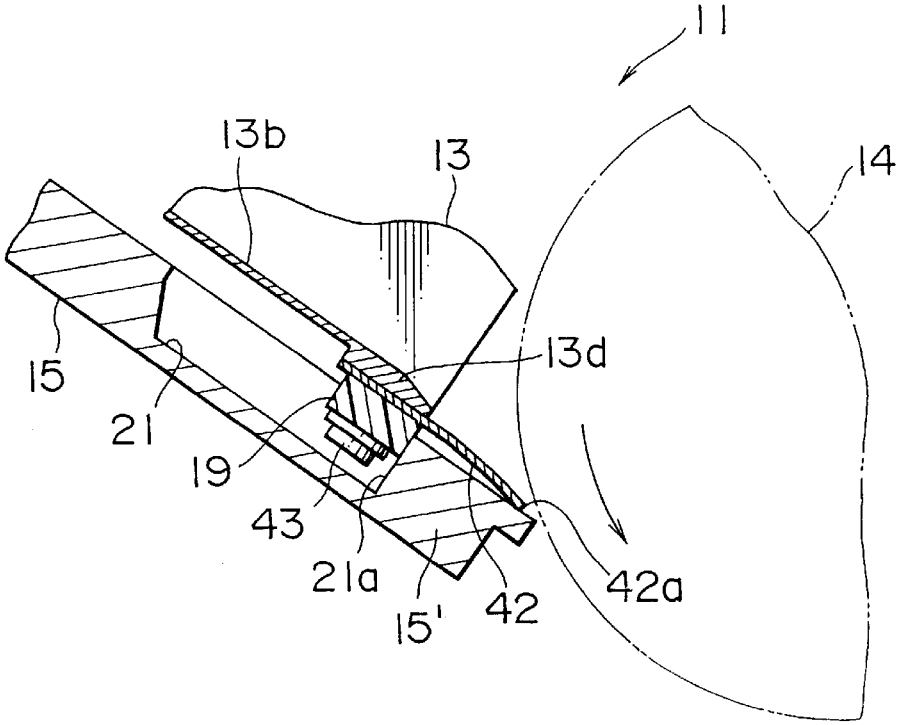
FIG. 7 is a perspective view showing a third embodiment of an ink supply apparatus for a printing press in accordance with the present invention, especially showing a state in which an ink tray is mounted.

FIG. 7 shows a third embodiment of the ink supply apparatus for a printing press in accordance with the present invention. For convenience of explanation, in FIG. 7, the same reference numerals are applied to the elements having the same function as that of the elements shown in FIGS. 1 to 4, and the detailed description thereof is omitted.

For the ink supply apparatus 11 for a printing press of this embodiment, a plate-shaped elastic member 42 having a curved shape in cross section is provided on the lower face of the bottom portion 13*b* of the ink tray 13. A tip end portion 42*a* of the plate-shaped elastic member 42 protrudes toward the ink fountain roller 14 beyond an end portion 13*d* of the bottom portion 13*b* of the ink tray 13. Thereby, the bottom portion 13*b* of the ink tray 13 is always brought into contact with the ink keys 15*a* to 15*n* via the tip end portion 42*a* of the plate-shaped elastic member 42. Therefore, even if a change in height (change in relative vertical position) of the ink tray 13 with respect to the ink fountain, 12 occurs, the contact state between the bottom portion 13*b* of the ink tray 13 and the ink blade 15 can always be kept good by the plate-shaped elastic member 42.

In this embodiment, since the plate-shaped elastic member 42 is added to the ink fountain 12 of the first embodiment described above, and the plate-shaped elastic member 42 is provided at the end portion 13*d* of the ink tray 13, almost all portions of the distal end portions 15 of the ink keys 15*a* to 15*n,* which have been exposed from the end portion 13*d* of the ink tray 13 in the first embodiment, are covered by the plate-shaped elastic member 42. Therefore, contamination of the ink fountain 12 can be reduced significantly as compared with the first embodiment.

The plate-shaped elastic member 42 can be fixed by various installation methods. For example, it can be fixed with machine screws 43 together with the second seal member 19, or it can be fixed with an adhesive. Also, the plate-shaped elastic member 42 may be installed so as to be detachable from the ink tray 13.

Other configurations such that the first and second seal members 18, 18, 19 are disposed on the ink tray 13, and these seal members are pressed on the step portions 20*a,* 21*a* of the ink fountain 12 are the same as in the case of the first embodiment.

Figure 8:
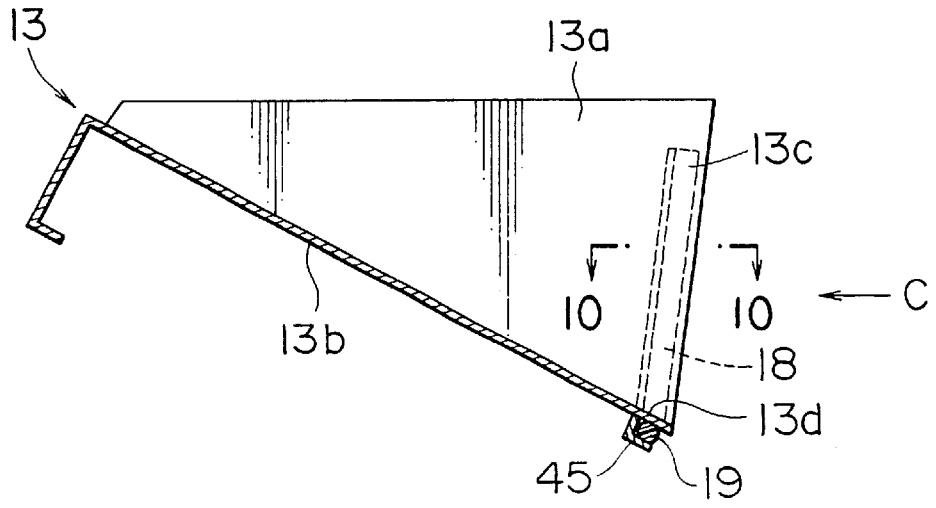
FIG. 8 is a side view showing a fourth embodiment of an ink supply apparatus for a printing press in accordance with the present invention, especially showing an ink tray therefor.
Figure 9:
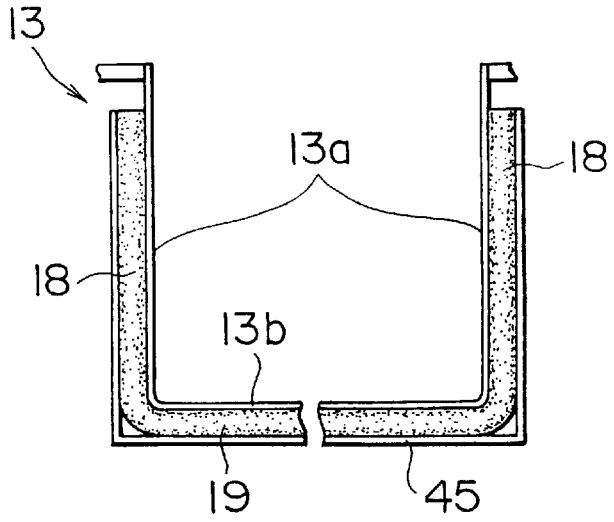
FIG. 9 is a front view of an ink tray viewed in the direction of the arrow C of FIG. 8.
Figure 10:
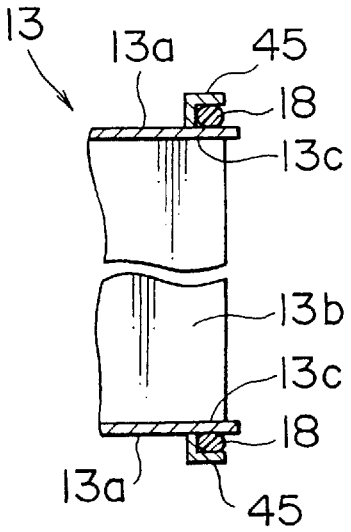
FIG. 10 is a sectional view taken in the direction of the arrows along the line D—D of FIG. 8.

FIGS. 8 to 10 show a fourth embodiment of the ink supply apparatus for a printing press in accordance with the present invention. For convenience of explanation, in FIGS. 8 to 10, the same reference numerals are applied to the elements having the same function as that of the elements shown in FIGS. 1 to 4, and the detailed description thereof is omitted.

For the ink supply apparatus 11 for a printing press of this embodiment, the first and second seal members 18, 19 are formed continuously i.e., integrally, by different portions of one seal member, and the seal member formed continuously is detachably installed to the ink tray 13.

Specifically, for the apparatus 11, as is apparent from the figures, a holder 45 having a substantially U shape in cross section is provided at the end portions 13*c,* 13*c,* 13*d* on the side of the ink fountain roller 14 of the side portions 13*a,* 13*a* and the bottom portion 13*b,* and the aforementioned continuous seal member (having respective end or leg portions and a central portion which form the first and second seal members 18, 18, 19 respectively) is fitted and held in the holder 45. Thereby, when it is desired to clean the ink tray, for example, for ink change, the ink tray 13 is removed from the ink fountain 12, and then the continuous seal member is pulled out of the holder 45. Since the ink tray 13 can be cleaned in this state, a seal portion in the vicinity of the holder 45 of the ink tray 13 can be cleaned easily, so that the cleaning operation for the ink tray 13 can be performed easily and rapidly.

Also, another embodiment of the present invention will be described below with reference to the drawings.

Figure 11:
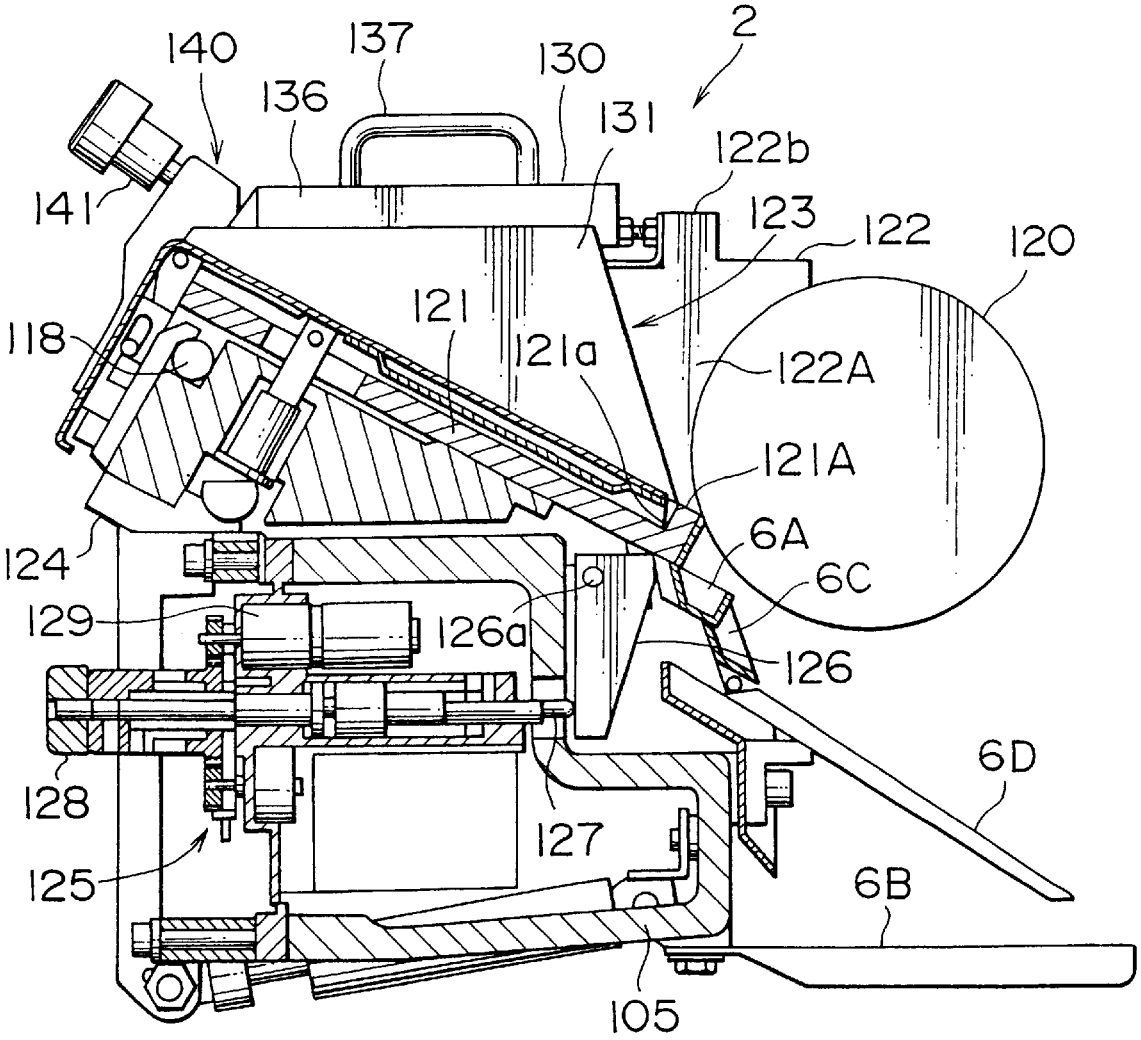
FIG. 11 is a side view showing a schematic construction of an ink supply apparatus provided with an ink tray in accordance with a fifth embodiment of the present invention.
Figure 12:
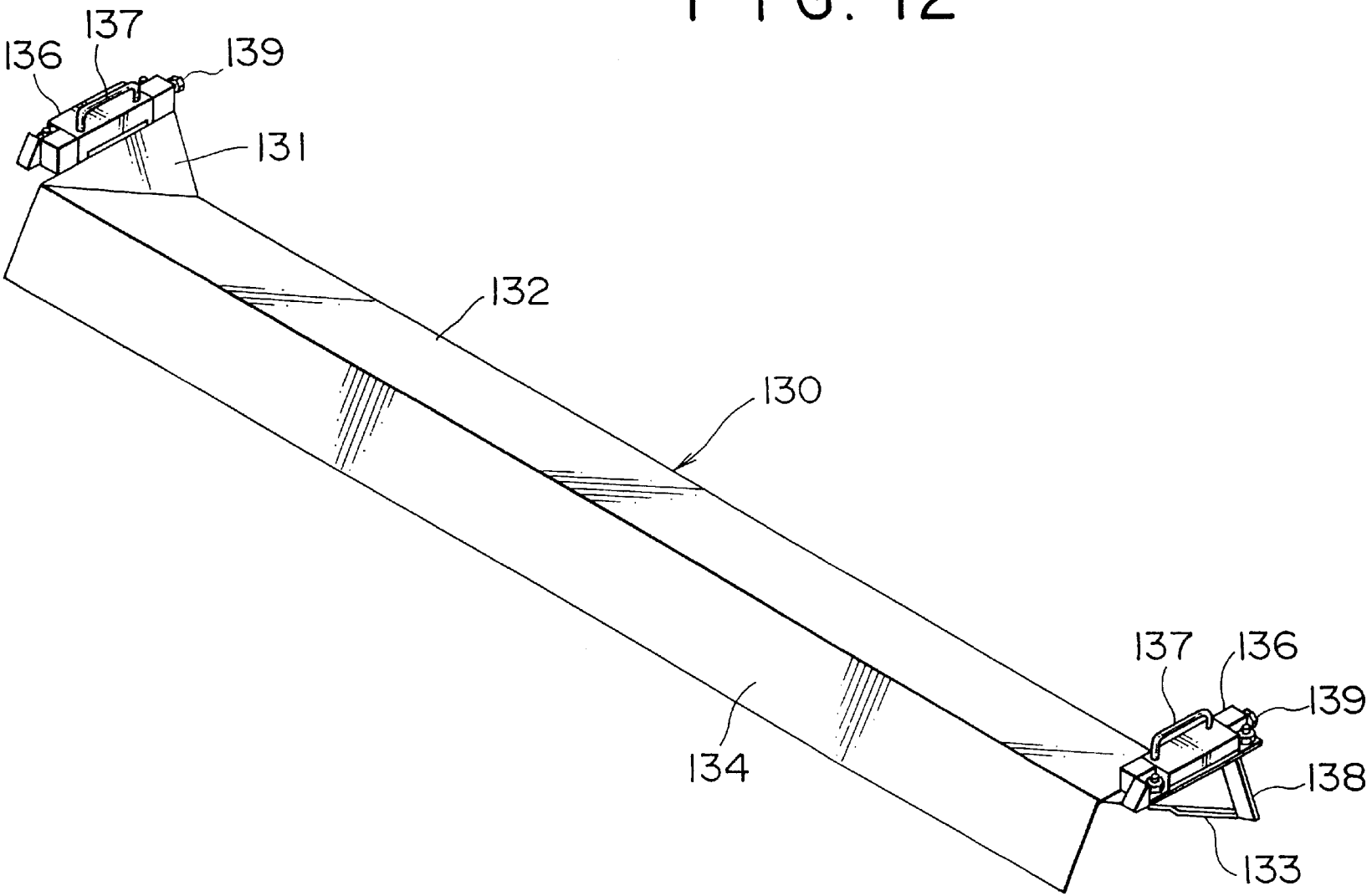
FIG. 12 is a perspective view showing a construction of an ink tray body in accordance with the fifth embodiment of the present invention.
Figure 13:
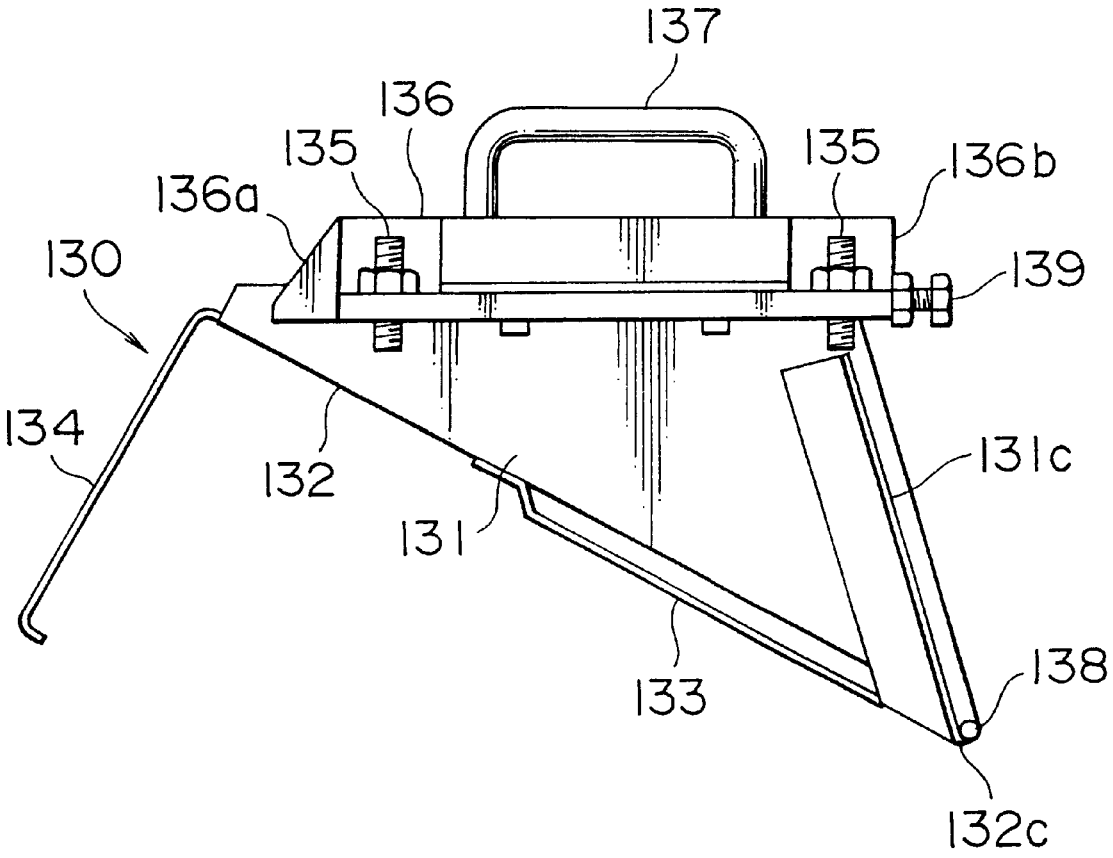
FIG. 13 is a side view showing a construction of an ink tray body in accordance with the fifth embodiment of the present invention.
Figure 14:
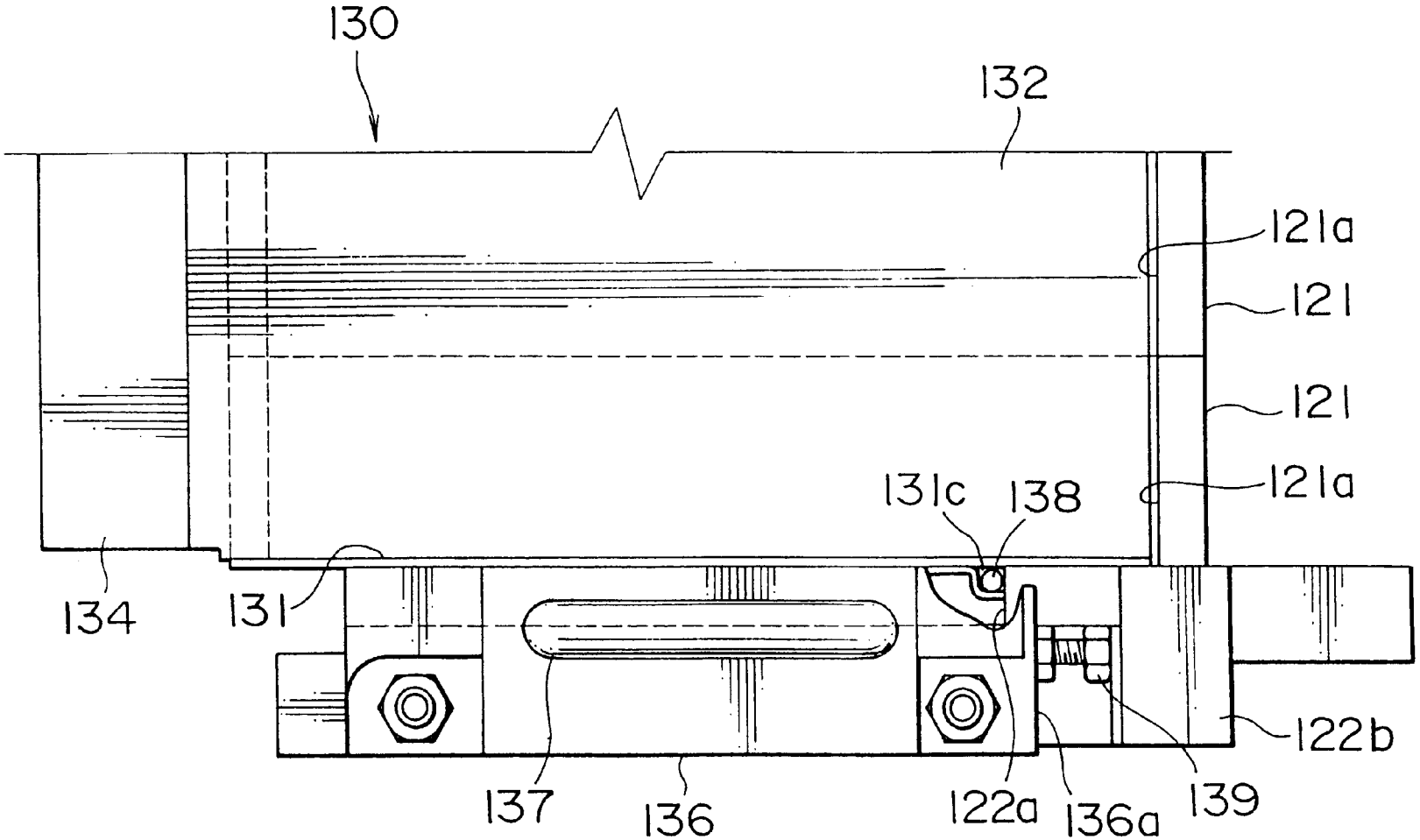
FIG. 14 is a view showing an engagement of an ink fountain with an ink tray in accordance with the fifth embodiment of the present invention, showing a bracket partially broken.
Figure 15A:
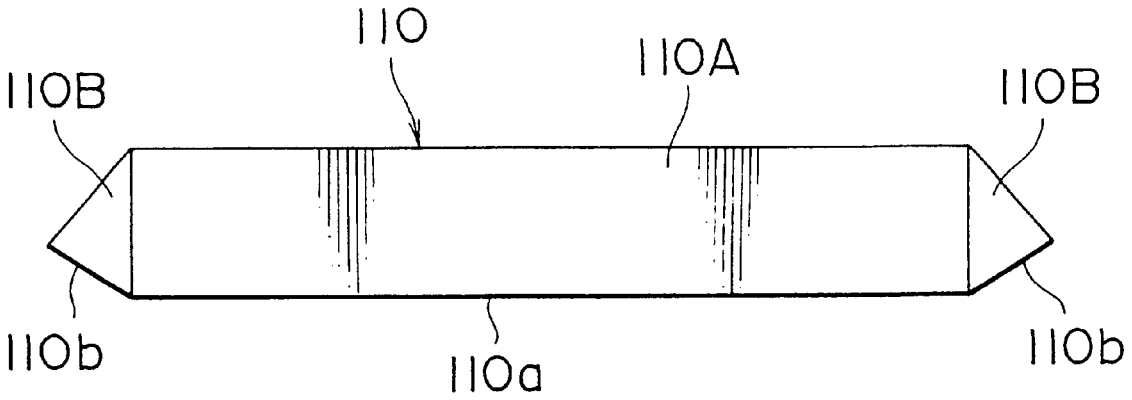
FIG. 15A and FIG. 15B are views showing a construction of a surface cover put on an ink tray in accordance with the fifth embodiment of the present invention, FIG. 15(*a*) being a plan view showing a shape before mounting, and FIG. 15(*b*) being a perspective view showing a shape at the time of mounting.
Figure 15B:
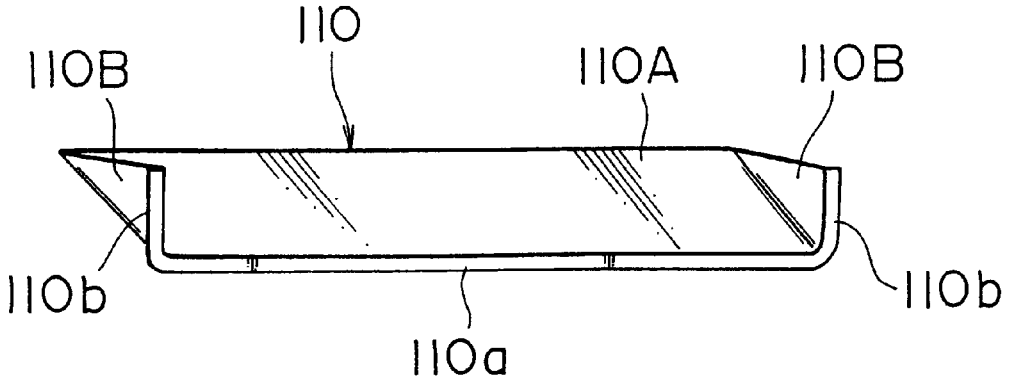
Figure 16:
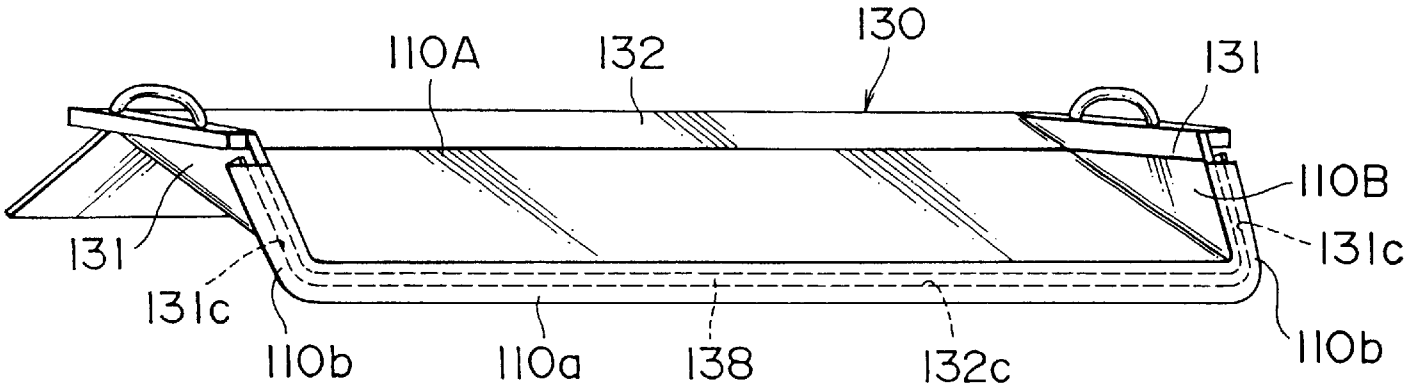
FIG. 16 is a perspective view showing a construction of an ink tray in accordance with the fifth embodiment of the present invention.

FIGS. 11 to 16 show an ink tray in accordance with a fifth embodiment of the present invention. FIG. 11 is a side view showing a schematic construction of an ink supply apparatus provided with this ink tray, FIGS. 12 to 14 are views showing a construction of this ink tray, and FIGS. 15 and 16 are views showing a construction of a surface cover put on this ink tray.

First, the schematic construction of the ink supply apparatus provides with this ink tray will be explained. As shown in FIG. 11, an ink supply apparatus 2 is, as in the case of the first embodiment, provided with an ink fountain 123 formed by the peripheral surface of an ink fountain roller 120, ink keys 121, and side plates 122, so that ink is stored in the ink fountain 123 and is supplied to the ink fountain roller 120 during the printing operation. The plurality of ink keys 121 are disposed in parallel in the width direction of the apparatus so as to be in close contact with each other, and the rear end portion of the ink key 121 is rotatably supported by a support shaft 118 provided on a support base 124. The side plates 122 are fixed to the support base 124 so as to hold the ink keys 121 therebetween from both sides, and the front end of the side plate 122 is in slidable contact with the peripheral surface of the ink fountain roller 120.

Also, a transverse beam 105 is provided under the ink fountain 123 to support members constituting the ink fountain 123. The transverse beam 105 is provided with an ink regulating device 125. The ink amount regulating device 125 is provided with an arm plate 126 engaging with the lower face at the distal end of each of the ink keys 121, and a pusher 127 the distal end of which is in contact with the arm plate 126 and which is extended and contracted in the longitudinal direction by the turning of a knob 128 or a motor 129. The pusher 127 is appropriately extended or contracted to vertically sway the arm plate 126 around a support pin 126*a,* whereby the distal end of the ink key 121 is swayed so that a gap between the ink key 121 and the ink fountain roller 120 is regulated to control the film thickness of the supplied ink. Under the distal end portion of the ink keys 121, there are provided a first ink catcher 6A for receiving ink dropping from the ink keys 121, and guides 6C and 6D for guiding the ink in the first ink catcher 6A to a second ink catcher 6B.

For the ink supply apparatus 2, an ink tray 130 is detachably mounted in the ink fountain 123. As shown in FIGS. 12 to 14, the ink tray 130 comprises side walls 131, 131 corresponding to the right and left side plates 122, 122 of the ink fountain 123, and a bottom plate 132 which is inclined downward toward the distal end thereof so as to correspond to the ink keys 121 forming the bottom portion of the ink fountain 123.

The lower surface of the bottom plate 132 is reinforced by a reinforcement plate 133. The rear end portion of the bottom plate 132 is extended downward to the outside, and this extension forms a cover 134 for preventing ink from adhering to the support base 124. At the upper end of the side wall 131, 131 of the ink tray 130, a bracket 136 is fixed so as to be directed to the outside, and a handle 137 is installed on the upper face of the bracket 136.

Most portions of the ink keys 121 and the side plates 122 are covered by the ink tray 130 (these portions are referred to as covered portions) so as to be prevented from being in direct contact with the ink in the ink fountain 123. The upper face of the distal end portion of the ink key 121 which is in slidable contact with the ink fountain roller 120 via the liquid film of ink and the inside face of the distal end portion of the side plate 122 are not covered by the ink tray 130, and are exposed so as to be in direct contact with the ink in the ink fountain 123 (these portions are referred to as exposed portions). That is to say, the inner peripheral surface of the ink fountain 123 is formed by the inside surface of the ink tray 130, the upper faces of the exposed portions (distal end portions) 121A of the ink keys 121, the exposed portions 122A of the side plates 122, and the outer peripheral surface of the ink fountain rollers 120.

Portions between the ink tray 130 and the distal end portions (exposed portions) 121A of the ink keys 121 and portions between the ink tray 130 and the exposed portions 122A of the side plates 122 form joints of the ink fountain 123, so that these portions must be sealed. Therefore, the outside faces of the distal end portions of the side walls 131, 131 and the bottom plate 132 are formed with concave grooves (groove portions) 131*c* and 132*c,* and a packing (seal member) 138 having a continuous seal face is fitted in the concave grooves 131*c* and 132*c*.

In a state in which the ink tray 130 is mounted in the ink fountain 123, apart of the packing 138 fitted in the concave groove 131*c* on the outside face of the distal end portion of the side wall 131 is pressed on a step portion 122*a* formed on the inside surface the side plate 122 of the ink fountain 123, and a part of the packing 138 fitted in the concave groove 132*c* on the outside face of the distal end of the bottom plate 132 is pressed on a step portion 121*a* (see FIG. 11) formed on the upper face of the distal end portion of the ink key 121.

By this packing 138, a seal is provided between the distal end portion of the side wall 131, 131 of the ink tray 130 and the side plate 122 of the ink fountain 123, and between the distal end portion of the bottom plate 132 of the ink tray 130 and the upper faces of the ink keys 121, so that the ink is prevented from leaking from the ink fountain 123 through the joints between the ink tray 130 and the ink keys 121 and between the ink tray 130 and the side plates 122.

The ink tray 130 is fixed to the ink fountain 123 by a pressing member 140 (see FIG. 11) provided on the support base 124. Specifically, by tightening a bolt 141 provided in the pressing member 140, a rear inclined face 136*a* (see FIG. 13) of the bracket 136 is pushed toward the distal end of the ink tray 130 (toward the gap between the ink keys 121 and the ink fountain roller 120), and the seal member 138 of the ink tray 130 is pressed on the step portions 122*a* and 121*a* of the ink fountain 123, whereby the ink tray 130 is fixed.

Also, as shown in FIGS. 11 to 14, a positioning bolt 139 for the ink tray 130 is provided at a front end portion 136*b* of each of the right and left brackets 136. By causing the positioning bolts 139 to abut on convex portions 122*b* provided on the upper faces of the side plates 122, the longitudinal mounting position of the ink tray 130 is regulated. The longitudinal position of the ink tray 130 is adjustable by adjusting the tightening amounts of the positioning bolts 139, and the vertical position thereof is adjustable by using height adjusting screws 135 provided in the brackets 136.

Thus, the contact area between the ink and the ink keys 121 is reduced significantly by detachably mounting the ink tray 130 in the ink fountain 123. Therefore, the possibility of the ink intruding into a gap between the ink keys 121, 121 is lessened, so that the operation of the ink key 121 becomes stable. Also, the time for cleaning the inside of ink fountain 123 can be shortened, so that the rate of operation of the equipment is increased, whereby the productivity can be enhanced.

As described above, by the use of the ink tray 130, the cleaning work for the ink fountain 123 is made easy, and the cleaning time is shortened. However, work for cleaning the contaminated ink tray 130 is created newly. Since the ink tray 130 can be replaced with a new one, the contaminated ink tray 130 need not be cleaned at the time of ink change. After being replaced with a new one and removed from the ink fountain 123, the contaminated ink tray 130 can be cleaned regardless of the operation of the equipment. In order to achieve labor saving for the whole operation and to enhance the productivity, however, it is also important to achieve the labor saving for the work for cleaning the ink tray 130.

Accordingly, for the ink tray 130 of this embodiment, a contamination preventive surface cover 110 is mounted on the surface thereof as shown in FIG. 15. The surface cover 110 is formed of paper or a resin film such as polyethylene and vinyl, and is composed of a rectangular portion 110A corresponding to the bottom plate 132 of the ink tray 130 and triangular portions 110B on both sides corresponding to the side walls 131 as shown in FIG. 15(*a*).

When the surface cover 110 is mounted on the ink tray 130, as shown in FIG. 15(*b*), the surface cover 110 is bent at the boundary lines between the rectangular portion 110A and the triangular portion 110B so as to match the shape of the inside surface of the ink tray 130, and further distal end portions 110*a* and 110*b* of the rectangular portion 110A and tile triangular portions 110B are bent toward the outside. After the packing 138 mounted at the distal end portion of the ink tray 130 is once removed from the concave grooves 131*c* and 132*c,* the surface cover 110 is mounted on the inside of the ink tray 130, and then the packing 138 is again mounted in the concave grooves 131*c* and 132*c* so as to hold the distal end portions 110*a* and 110*b* of the surface cover 110 as shown in FIG. 16.

Thus, by holding the distal end portions 110*a* and 110*b* in the concave grooves 131*c* and 132*c* by means of the packing 138, the surface cover 110 is fixed on the inside of the ink tray 130, so that the surface of the ink tray 130 is covered by the surface cover 110. The ink tray 130 is installed in the ink fountain 123 with the surface cover 110 being mounted in this manner.

Since the ink tray in accordance with the fifth embodiment of the present invention is configured as described above, even when the ink tray 130 is mounted in the ink fountain 123 and ink is put in the ink fountain 123, the ink does not adhere directly to the ink tray 130 because the surface of the ink tray 130 is covered by the surface cover 110.

Therefore, at the time of cleaning operation, it is necessary only that the surface cover 110 and the packing 138, to which ink adheres, be removed from the ink tray 130, and the surface cover 110 and the packing 138 be replaced with new ones. Also, since the surface cover 110 can be thrown away after use, only the packing 138 has to be cleaned. When the surface cover 110 is mounted on the ink tray 130, wrinkles are produced between the distal end portion 110*a* of the rectangular portion 110A and the distal end portion 110*b* of the triangular portion 110B. However, this does not lead to the occurrence of ink leakage etc., so that no problem occurs in practical use.

According to the ink tray of this embodiment, since the surface of the ink tray 130 is covered by the surface cover 110, even when ink is put in the ink fountain 123, the ink does not adhere directly to the ink tray 130, and the surface cover 110 can be thrown away and need not be cleaned. Therefore, the cleaning work is made easy at the time of ink change or at the completion of printing operation, so that the operator's burden is alleviated.

Moreover, the surface cover 110 is fixed to the ink tray 130 by being fitted in the concave grooves 131*c* and 132*c* for the packing 138 so that the front end portion of the surface cover 110 is held between the packing 138 and the concave grooves 131*c* and 132*c* (method for mounting a contamination preventive surface cover to an ink tray in accordance with this embodiment). Therefore, the work for mounting the surface cover 110 is easy, and a new structure for fixing the surface cover 110 is unnecessary, which eliminates a complicated construction of the ink tray 130 and restrains an increase in cost.

The shape of the surface cover 110 is not limited to the shape such that the ink tray 130 is developed as in the above embodiment, and can be any shape at least having a size enough to cover a portion of the tray 130 to which ink adheres when it is put in the ink fountain 123.

Figure 17:
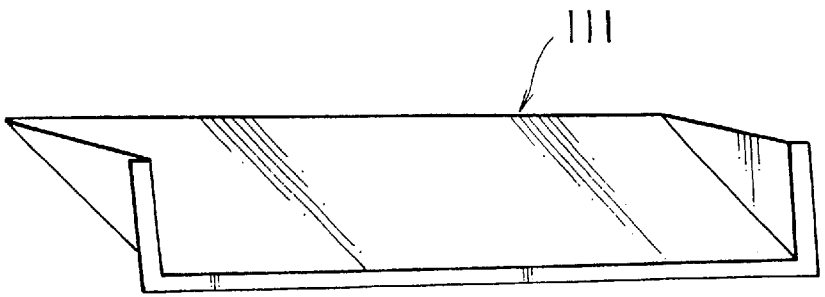
FIG. 17 is a perspective view showing another construction of a surface cover put on an ink tray in accordance with the fifth embodiment of the present invention.

Also, although the surface cover 110 of the above embodiment has a plane shape consisting of the rectangular portion 110A and the triangular portions 110B on both sides, a surface cover Ill of a three-dimensional shape matching the inside shape of the ink tray 130 may be used as shown in FIG. 17.

When the three-dimensionally shaped surface cover 111 is used, unlike the case where the plane-shaped surface cover 110 is mounted on the ink tray 130, no wrinkle is produced between the distal end portion 110*a* of the rectangular portion 110A and the distal end portion 110*b* of the triangular portion 110B, so that the surface cover 111 can be brought into closer contact with the ink tray 130. Therefore, when the remaining ink is scraped off with a spatula or the like while the ink tray 130 is mounted in the ink fountain 123, the possibility of the surface cover 111 being broken is lessened.

Figure 18:
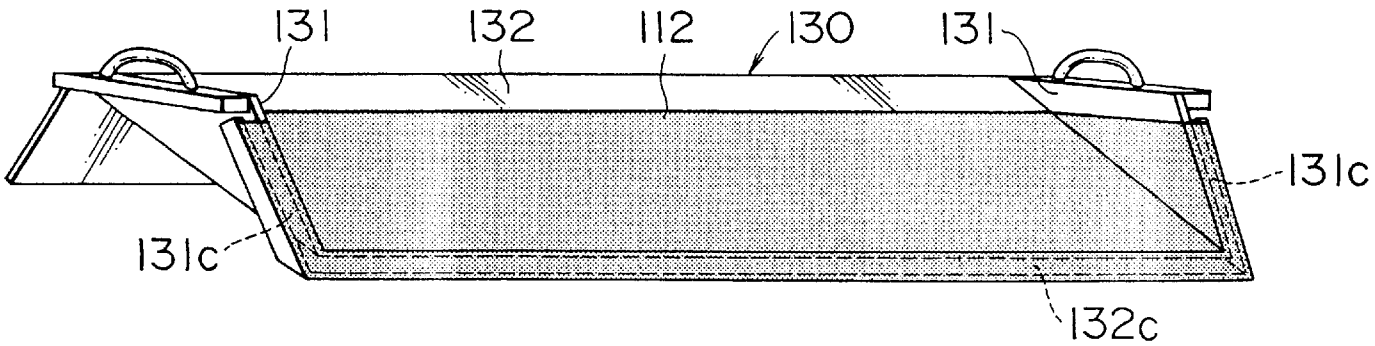
FIG. 18 is a perspective view showing a construction of an ink tray in accordance with a sixth embodiment of the present invention.

Next, an ink tray in accordance with a sixth embodiment will be described. FIG. 18 is an explanatory view for illustrating this embodiment. The construction of an ink tray body of this embodiment is the same as that of an ink tray body described in the above-described fifth embodiment.

In this embodiment, as shown in FIG. 18, the surface of the ink tray 130 is coated with a film 112 capable of being peeled off. The portion coated with this film 112 is the portion to which ink adheres when it is put in the ink fountain 123, and specifically is a portion including the surfaces of the bottom plate 132 and the side walls 131, the inside of the concave grooves 132*c* and 131*c* in which the packing 138 is fitted, and the vicinities thereof.

If the surface of the ink tray 130 is coated with the film 112, ink does not adhere to the surface of the ink tray 130, but adheres to the film 112 formed on the surface. Therefore, when the ink tray 130 is cleaned, the film 112 has only to be peeled off together with the adhering ink.

Thus, according to the ink tray of this embodiment, since the surface of the ink tray 130 is coated with the film 112, even when ink is put in the ink fountain 123, the ink does not adhere directly to the ink tray 130, and the ink can be removed merely by peeling off the film 112. Therefore, the cleaning work is made easy at the time of ink change or at the completion of printing operation, so that the operator's burden is alleviated.

Although the film 112 is preferably formed on all portions to which ink adheres when it the tray 130 is put in the ink fountain 123 in the above-described embodiment, only the portions which are especially difficult to clean, for example, the insides of the concave grooves 132*c* and 131*c* in which the packing 138 is fitted and the vicinities thereof can be coated with the film 112 if desired. In this case as well, the ink tray 130 can be cleaned only by cleaning the surfaces of the bottom plate 132 and the side wall 131 from which ink can be removed relatively easily. Therefore, the cleaning work is made easy at the time of ink change or at the completion of printing operation, so that the operator's burden is alleviated.

The above is a description of two embodiments of the ink tray in accordance with the present invention. The present invention is not limited to the above-described embodiments, and various modifications may be made without departing from the spirit and scope of the present invention. For example, both of the surface cover 110 and the film 112 can be used. Specifically, the ink tray 130 coated with the film 112 can be mounted with the surface cover 110.

Also, in the above-described embodiments, the cleaning work for the ink tray 130 is made easy by preventing ink from adhering to the body of the ink tray 130. However, even when ink adheres to the body of the ink tray 130, the cleaning work can be made easy if the adhering ink can be removed easily. Therefore, it can be thought that the surface of the ink tray 130 is coated with a film having a reduced affinity for ink as compared to the tray surface, i.e., a film made of an antistick contact surface material with a low coefficient of friction. Specifically, the surface of the ink tray 130 may be coated with a film made of an antistick, nonwetting contact surface resin with a low coefficient of friction, such as fluoropolymer resins and silicone resins. The coating of fluoropolymer resin can be made by the dispersion method, for example. With this method, a powder of fluoropolymer resin is suspended in a solvent to yield dispersion, and after spray coating, the dispersion is evaporated and dried and then the coating is heated in a heating oven. The portions coated with the film of the ink tray 130 are portions to which ink adheres when it is put in the ink fountain 123. Specifically, the portions are the surfaces of the bottom plate 132 and the side walls 131, the insides of the concave grooves 132*c* and 131*c* in which the packing 138 is fitted, and the vicinities thereof.

Thus, if the surface of the ink tray 130 is coated with the film less likely to be contaminated with ink, even when ink adheres to the body of the ink tray 130, the adhering ink can be removed easily. Therefore, the cleaning work is made easy at the time of ink change or at the completion of printing operation, so that the operator's burden is alleviated. Also, in this case as well, only the portions which are especially difficult to clean, for example, the insides of the concave grooves 132*c* and 131*c* in which the packing 138 is fitted and the vicinities thereof may be coated. Further, the surface cover 110 may be mounted on the ink tray 130 coated with the film less likely to be contaminated with ink, which makes the cleaning work easier.

Also, the shape of the ink tray 130 is not limited to the above-described one if the ink tray 130 is detachable from the ink fountain 123, and contamination on the inside surface of the ink fountain 123 can be prevented.

Further, another embodiment of the present invention will be described below with reference to the accompanying drawings.

Figure 19:
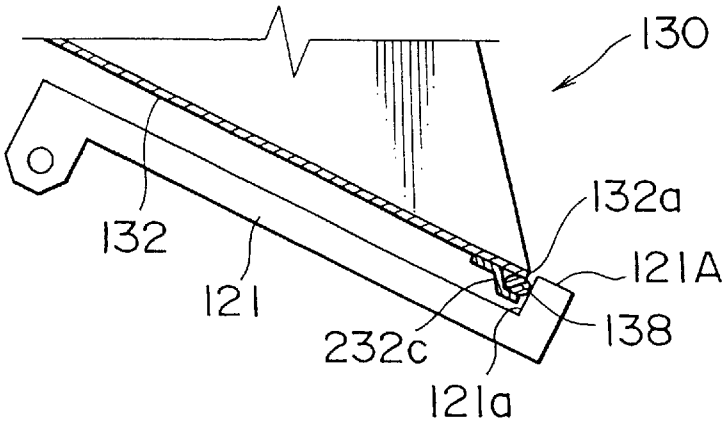
FIG. 19 is a side sectional view showing an engagement of an ink fountain with the bottom plate of an ink tray for an ink supply apparatus in accordance with a seventh embodiment of the present invention.

FIG. 19 shows an ink supply apparatus in accordance with a seventh embodiment of the present invention, showing a construction of an ink tray for the ink supply apparatus. The schematic construction of this ink supply apparatus and the construction of the ink tray are the same as those of the above-described fifth embodiment shown in FIGS. 11 to 13, so that only different constructions will be described.

The ink tray 130 is mounted in the ink fountain 123 by placing the right and left brackets 136, 136 on the side plates 122, 122 of the ink fountain 123, and the ink tray 130 is locked and positioned by locking portions formed in the ink fountain 123. Here, as the locking portions, the step portion 122*a* (see FIG. 21) is formed on the inside surface of the side plate 122, and the step portion 121*a* is formed on the upper face of the distal end portion of the ink key 121 constituting the bottom portion of the ink fountain 123.

Various positional relationships can be provided between the step portions 122*a* and 121*a* and the ink tray 130. For the step portion 121*a* formed on the ink key 121, considering that the remaining ink is scraped off with a spatula or the like when the ink fountain 123 is cleaned, the distal end portion (exposed portion) 121A of the ink key 121 should preferably be flush with the bottom plate 132 of the ink tray 130 as shown in FIG. 19. Also, in order to prevent ink leakage through the gap between a distal end 132*a* of the bottom plate 132 and the step portion 121*a*, it is preferable that a holder 232*c* be provided at the lower part of the distal end 132*a* to hold the packing 138 so that the packing 138 is brought into contact with the step portion 121*a*.

Figure 20A:
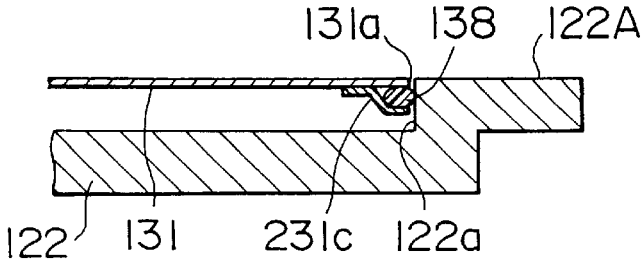
FIG. 20A, FIG. 20B and FIG. 20C are sectional views showing an engagement of an ink fountain with the side wall of an ink tray devised in a process in which the present invention was made, FIG. 20(*a*) being a view showing one example, FIG. 20(*b*) being a view showing another example, and FIG. 20(*c*) being a view for illustrating problems in FIGS. 20(*a*) and 20(*b*)
Figure 20B:
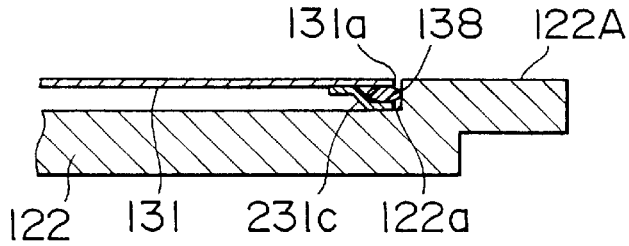
Figure 20C:
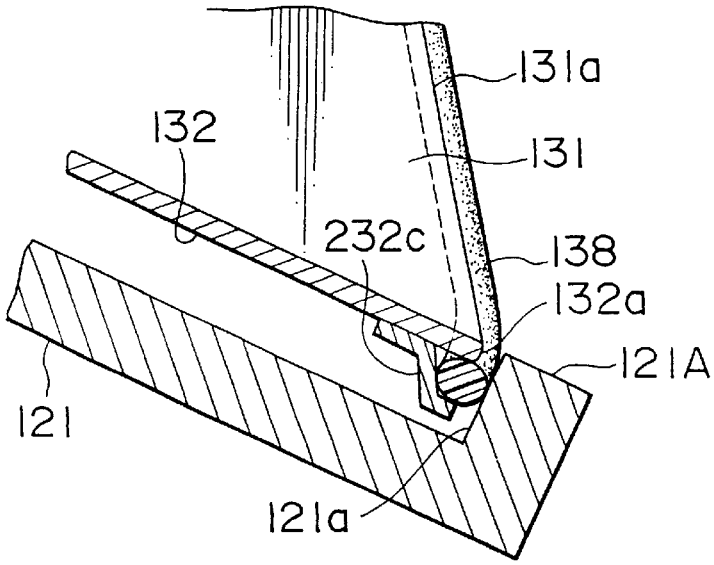

On the other hand, for the step portion 122*a* formed on the side plate 122, it is advantageous that the exposed portion 122A of the side plate 122 of the ink fountain 123 is made flush with the side wall 131 of the ink tray 130 as shown in FIG. 20(*a*). In this case, however, the positioning in the transverse direction must be performed visually by the operator, so that it is difficult to perform positioning always accurately. Also, for the transverse positioning, it can be advantageous that a holder 231*c* for holding the packing 138 is caused to abut on the side plate 122 as shown in FIG. 20(*b*). In this case, however, the holder 231*c* is installed to the ink tray 130 afterward, so that a larger manufacturing error than the body of the ink tray 130 is produced, and sometimes the holder 231*c* interferes with the side plate 122, whereby the ink tray 130 cannot be mounted.

Further, as shown in FIGS. 20(*a*) and 20(*b*), when the exposed portion 122A of the side plate 122 is attempted to be made flush with the side wall 131, if a distal end 131*a* of the side wall 131 is inclined with respect to the bottom plate 132, the packing 138 must be bent into a three-dimensional, unnatural shape as shown in FIG. 20(*c*) to seal the gap between the side wall 131 and the side plate 122. Therefore, it becomes difficult to hold the packing 138 at the connecting portion between the side wall 131 and the bottom plate 132.

Thereupon, in the ink supply apparatus 2 of this embodiment, when the ink tray 130 in which the distal end 131*a* of the side wall 131 is inclined with respect to the bottom plate 132, pot at right angles thereto, as shown in FIG. 13 is provided, the positional relationship between the step portions 122*a* and 121*a* and the ink tray 130 is set as described below. Specifically, for the step portion 121*a* formed on the ink key 121, the packing 138 is held by the holder 232*c* provided on the lower surface of the bottom plate 132, and the packing 138 is protruded so as to be in contact with the step portion 121*a*, whereby the distal end portion (exposed portion) 121A of the ink key 121 is made flush with the bottom plate 132.

Figure 21A:
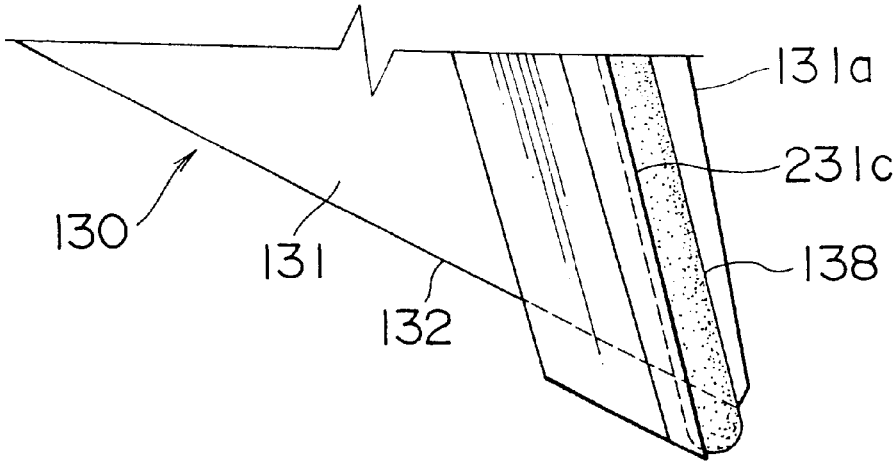
FIG. 21A and FIG. 21B are views illustrating an engagement of an ink fountain with the side wall of an ink tray for an ink supply apparatus in accordance with the seventh embodiment of the present invention, FIG. 21(*a*) being a side view showing a mounting state of a packing to the side wall of an ink tray, and FIG. 21(*b*) being a sectional view showing an engagement of an ink fountain with the side wall of an ink tray.
Figure 21B:
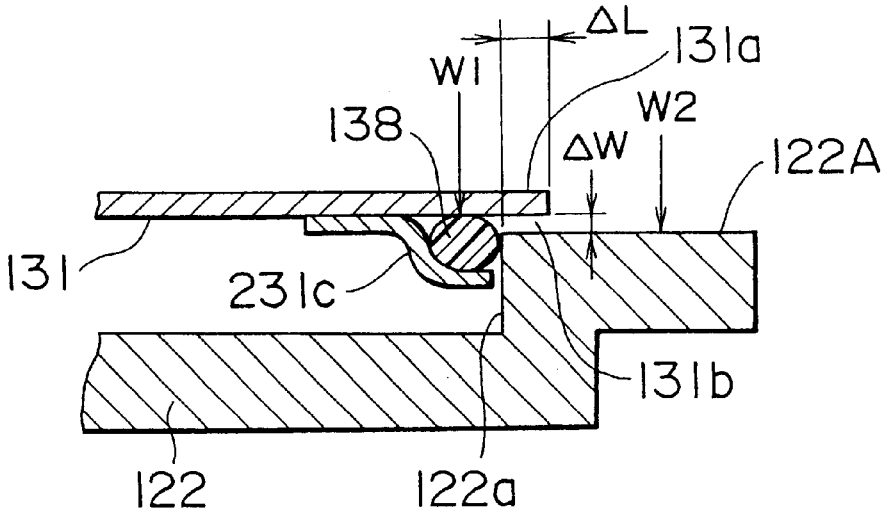
Figure 22:
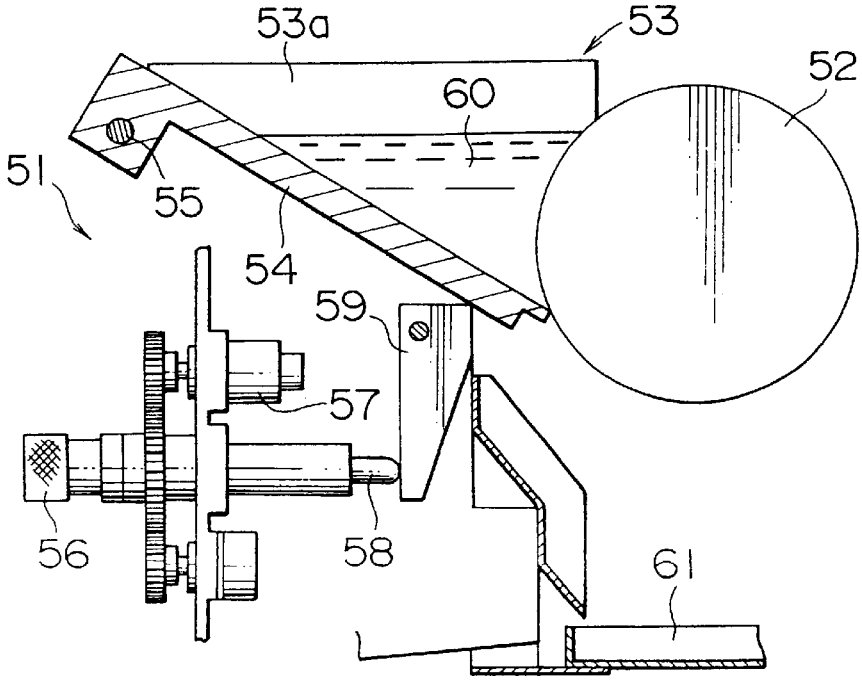
FIG. 22 RELATED ART
FIG. 22 is a partially longitudinal sectional view of a conventional ink supply apparatus for a printing press.
Figure 23:
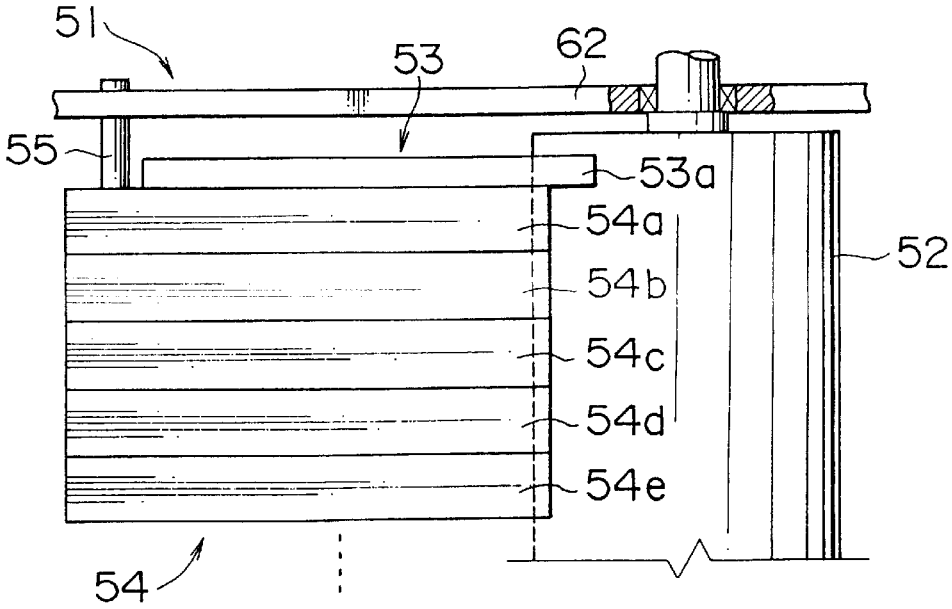
FIG. 23 RELATED ART
FIG. 23 is a plan view of a conventional ink supply apparatus for a printing press.

On the other hand, for the step portion 122*a* formed on the side plate 122, as shown in FIG. 21(*a*), the holder 231*c* is provided at a position shifted slightly rearward from the distal end 131*a* of the side wall 131, and the packing 138 held by the holder 232C provided on the lower surface of the bottom plate 132 is bent to be held by the holder 231*c*. By providing the holder 231*c* so as to be shifted rearward from the distal end 131*a* of the side wall 131 in this manner, the packing 138 is withdrawn slightly rearward from the distal end 131*a* of the side wall 131. However, the packing 138 can be set in a natural form.

As shown in FIG. 21(*b*), an outside width W1 between the side walls 131, 131 of the ink tray 130 is set to be slightly narrower than an inside width W2 between the side plates 122, 122, and the distal ends 131*a*, 131*a* of the side walls 131, 131 are inserted between the side plates 122, 122, whereby the portion of the packing 138 held between the holder 231*c* is brought into contact with the step portion 122*a*. At this time, a lapping portion 131*b* of the side wall 131, which laps on the exposed portion 122A, is produced on the inside of the exposed portion 122A of the side plate 122. When the ink tray 130 moves transversely, the lapping portion 131*b* abuts on the exposed portion 122A of the side plate 122 to regulate the movement of the ink tray 130. That is to say, the distal ends 131*a*, 131*a* of the side walls 131, 131 are inserted between the side plates 122, 122 so that the packing 138 comes into contact with the step portion 122*a*. Thereby, the positioning of the ink tray 130 in the longitudinal direction and in the transverse direction is performed at the same time.

If a length •L of the lapping portion 131*b* is too long, the side wall 131 may be stuck to the side plate 122 by the intruding ink. Therefore, in the ink supply apparatus 2 of this embodiment, the length •L of the lapping portion 131*b* is set to a degree such that transverse positioning can be performed (for example, about 1.0 mm). Also, a gap width •W of the lapping portion 131*b* is set to a degree such that there is no difficulty in mounting the ink tray 130 caused by the interference of the distal end 131*a* of the side wall 131 with the step portion 122*a* (for example, about 0.5 mm).

Next, the fixation of the positioned ink tray 130 to the ink fountain 123 will be described. The ink tray 130 is fixed by the pressing member 140 (see FIG. 11) provided on the support base 124. Specifically, by tightening the bolt 141 provided, in the pressing member 140, the rear inclined face 136*a* of the bracket 136 is pushed toward the distal end of the ink tray 130. Thereby, the seal member 138 held by the holders 231*c* and 232*c* is pressed on the step portions 122*a* and 121*a* of the ink fountain 123, whereby the ink tray 130 is fixed.

Also, the positioning bolt 139 for the ink tray 130 is provided at the front end portion 136*b* of each of the right and left brackets 136. By causing the positioning bolts 139 to abut on the convex portions 122*b* provided on the upper faces of the side plates 122, the longitudinal mounting position of the ink tray 130 is regulated. The longitudinal position of the ink tray 130 is adjustable by adjusting the tightening amounts of the positioning bolts 139, and the vertical position thereof is adjustable by using the height adjusting screws 135 provided in the brackets 136.

Since the ink supply apparatus in accordance with the seventh embodiment of the present invention is configured as described above, when ink is changed for order change etc., the apparatus is first stopped, and the ink remaining in the ink fountain 123 is recovered with a spatula or the like. Then, the fixation of the ink tray 130 by the pressing member 140 is released, and the ink tray 130 is removed from the ink fountain 123 by grasping the handles 137.

After the ink tray 130 is removed, the remaining ink adhering to the distal end portions of the ink keys 121 and the side plates 122 is wiped off with a waste cloth or the like or washed off with a cleaning fluid. The removed ink tray 130 is cleaned on the outside of the ink change process. After the inside of the ink fountain 123 has been cleaned, a new ink tray 130 is brought and mounted in the ink fountain 123.

The ink tray 130 is mounted into the ink fountain 123 by the following procedure. First, the right and left brackets 136, 136 of the ink tray 130 are placed on the right and left side plates 122 of the ink fountain 123, by which the ink tray 130 is temporarily mounted in the ink fountain 123. Next, while checking the positional relationship between the step portions 122*a* of the right and left side plates 122 and the side walls 131, the distal ends 131*a*, 131*a* of the right and left side walls 131, 131 are inserted between the step portions 122*a*, 122*a*. Then, the ink tray 130 is pushed forward until the packing 138 comes into contact with the step portions 121*a* and 122*a*.

When the longitudinal positioning has been completed, the bolts 141 in the pressing members 140 are tightened to press the packing 138 on the step portions 121*a* and 122*a*. Thereby, the ink tray 130 is fixed to the ink fountain 123 while providing a seal between the ink tray 130 and the ink fountain 123. At this time, the tightening amounts of the positioning bolts 139 and the height adjusting screws 135 are adjusted to control the position of the ink tray 130, if necessary.

Thus, according to the ink supply apparatus of this embodiment, by mounting the ink tray 130 in the ink fountain 123, the contact area of the ink keys 121 with ink can be reduced significantly. Therefore, the possibility of ink intruding into the gap between the ink keys 121, 121 is lessened, so that the operation of the ink keys 121 is stabilized. Also, the cleaning work in the ink fountain 123 is made easy.

Also, the contaminated ink tray 130 need not be cleaned at the time of ink change, but is replaced with a new one, having only to be cleaned on the outside of the ink change process after being removed. Therefore, the cleaning time at the time of ink change can be shortened, so that the rate of operation of the equipment is increased, whereby the productivity can be enhanced.

Further, according to the ink supply apparatus of this embodiment, the positioning of the ink tray 130 in the ink fountain 123 is accomplished merely by inserting the distal ends 131*a*, 131*a* of the right and left side walls 131, 131 between the step portions 122*a*, 122*a* and by pushing the ink tray 130 forward until the packing 138 comes into contact with the step portions 121*a* and 122*a*, so that the ink tray 130 can be mounted in the ink fountain 123 easily and accurately. Therefore, the possibility of ink leakage though the gap between the ink tray 130 and the ink fountain 123 is lessened, and also the time taken for the mounting of the ink tray 130 is shortened, whereby the productivity can further be enhanced.

The present invention is not limited to the above embodiment, and various modifications can be made without departing from the spirit and scope of the present invention. For example, in the above embodiment, the case where the distal end 131*a* of the side wall 131 is inclined with respect to the bottom plate 132 has been described as an exemplary shape of the ink tray 130 in the above embodiment. However, the present invention can be applied to the case where the distal end 131*a* of the side wall 131 is at right angles to the bottom plate 132 or at any angle thereto. In this case as well, by providing the lapping portion between the side wall 131 and the bottom plate 132, the transverse position can be determined mechanically.

What is claimed is:

1. An ink supply apparatus for a printing press having an ink fountain formed by an ink fountain roller, a plurality of ink blades arranged in the axial direction of said ink fountain roller, and side plates positioned at opposite ends of said plurality of ink blades, so that the quantity of ink fed from said ink fountain to said ink fountain roller is controlled by regulating a gap between said ink blades and said ink fountain roller, wherein an ink tray comprising an integrally formed bottom portion covering portions of upper faces of said ink blades excluding distal end portions thereof and integrally formed side portions respectively covering inside surfaces of said side plates is provided, wherein for each side portion of said side portions of said ink tray a respective first seal member is interposed between said side portion and the inside surface of said side plate that is covered by said side portion, and a second seal member in slidable contact with said ink blades is interposed between said ink blades and the bottom portion of said ink tray.

2. The ink supply apparatus for a printing press according to claim 1, wherein said ink tray is detachable from said ink fountain.

3. The ink supply apparatus for a printing press according to claim 2, wherein said first and second seal members are installed on said ink tray.

4. The ink supply apparatus for a printing press according to claim 3, wherein said first and second seal members are detachable from said ink tray.

5. The ink supply apparatus for a printing press according to claim 3, wherein said first and second seal members are positioned in the vicinity of ends of the side portions and bottom portion of said ink tray.

6. The ink supply apparatus for a printing press according to claim 5, wherein said first and second seal members are a continuous integral seal member.

7. The ink supply apparatus for a printing press according to claim 5, wherein said second seal member abuts on said ink blades.

8. The ink supply apparatus for a printing press according to claim 7, wherein a plate-shaped elastic member, whose tip end portion protrudes toward said ink fountain roller beyond the bottom portion of said ink tray, is mounted on a lower face of the end portion of said ink tray, and the tip end portion of said plate-shaped elastic member is positioned to abut on said ink blades, whereby the bottom portion of said ink tray is brought into contact with said ink blades via the tip end portion of said plate-shaped elastic member.

9. The ink supply apparatus for a printing press according to claim 1, wherein each of said ink blades has a distal end portion and an opposite proximal end portion, and the proximal end portion is mounted for pivoting.

10. The ink supply apparatus for a printing press according to claim 9, wherein said second seal member is installed on the lower face of the end portion of the bottom portion of said ink tray adjacent the edge of said ink fountain roller, and for each of said ink blades a substantially square-shaped concave portion is formed on the upper face of said ink blade, and said second seal member is positioned to abut on a step portion of said concave portion on the side of the concave portion closest to the ink fountain roller.

11. The ink supply apparatus for a printing press according to claim 10, wherein said second seal member is made of an elastic material.

12. The ink supply apparatus for a printing press according to claim 11, wherein for each of said ink blades the step portion defines an arcuate curved shape for engaging the second seal member.

13. The ink supply apparatus for a printing press according to claim 1, wherein a positioner is provided for positioning said ink tray with respect to said ink fountain.

14. The ink supply apparatus for a printing press according to claim 1, further comprising a suppressing mechanism for urging said ink tray toward said fountain roller.

15. An ink tray mounted in an ink fountain for a printing press formed by an ink fountain roller, a plurality of ink blades arranged in the axial direction of said ink fountain roller, and side plates positioned at opposite ends of said plurality of ink blades, wherein said ink tray is integrally formed by a bottom portion covering portions of upper faces of said ink blades excluding distal end portions thereof and side portions respectively covering inside surfaces of said side plates, and said ink tray is mounted in said ink fountain in such a manner that for each side portion of said side portions of said ink tray a respective first seal member is interposed between said side portion and the inside surface of said side plate that is covered by said side portion, and a second seal member is interposed between said ink blades and the bottom portion of said ink tray.

16. The ink tray according to claim 15, wherein said ink tray is detachable from said ink fountain.

17. The ink tray according to claim 16, wherein said first and second seal members are installed on said ink tray.

18. The ink tray according to claim 17, wherein said first and second seal members are detachable from said ink tray.

19. The ink tray according to claim 18, wherein said first and second seal members are portions of a continuous integral seal member.

20. The ink tray according to claim 17, wherein said second seal member is installed at an end of the bottom portion of said ink tray and said first seal members are respectively installed at ends of said side portions of said ink tray.

* * * * *

UNITED STATES PATENT AND TRADEMARK OFFICE

CERTIFICATE OF CORRECTION

PATENT NO. : 6,418,848 B1
DATED : July 16, 2002
INVENTOR(S) : Fujimoto et al.

It is certified that error appears in the above-identified patent and that said Letters Patent is hereby corrected as shown below:

Title page,
Item [56], References Cited, FOREIGN PATENT DOCUMENTS, insert the following:
-- JP 6-59046 8/1994 --.

Signed and Sealed this

Fifth Day of November, 2002

*Attest:*

*Attesting Officer*

JAMES E. ROGAN
*Director of the United States Patent and Trademark Office*